US005775400A

United States Patent [19]

Wilkinson

[11] Patent Number: 5,775,400

[45] Date of Patent: Jul. 7, 1998

[54] INSTANT SCREEN DOOR

[76] Inventor: Anthony Wilkinson, 38 Winding Wood Dr. Apt. 5A, Sayreville, N.J. 08872

[21] Appl. No.: 695,120

[22] Filed: Aug. 5, 1996

[51] Int. Cl.[6] ..... A47G 5/02

[52] U.S. Cl. ..... 160/323.1; 160/903

[58] Field of Search ..... 160/323.1, 263, 160/903, 23.1, 324, 325, 326, DIG. 10; 248/266, 268, 264, 265, 267, 269, 270

[56] References Cited

U.S. PATENT DOCUMENTS

| | | | |
|---|---|---|---|
| 182,767 | 10/1876 | Nowell | 160/DIG. 10 X |
| 293,915 | 2/1884 | Spencer | 160/DIG. 10 X |
| 306,244 | 10/1884 | Grundler | 248/269 |
| 337,192 | 3/1886 | Peck | 160/DIG. 10 X |
| 438,857 | 10/1890 | McCormack | 248/266 |
| 473,990 | 5/1892 | Wilkinson | 160/323.1 X |
| 484,540 | 10/1892 | McKerlie | 160/DIG. 20 X |
| 567,466 | 9/1896 | Girouard | 248/266 |
| 576,951 | 2/1897 | Crigler | 248/266 |
| 698,620 | 4/1902 | Baker | 160/315 |
| 746,403 | 12/1903 | Tarney | 160/DIG. 10 X |
| 778,228 | 12/1904 | Dodge et al. | 160/DIG. 8 X |
| 841,089 | 1/1907 | Kiser | 248/269 |
| 906,542 | 12/1908 | Millard | 160/323.1 |
| 908,810 | 1/1909 | Smith | 248/269 |
| 999,675 | 8/1911 | Schmitz | 248/261 |
| 1,054,535 | 2/1913 | Grigg | 160/323.1 |
| 1,090,931 | 3/1914 | McLean | 160/313 |
| 1,221,210 | 4/1917 | Parichan | 248/266 |
| 1,278,934 | 9/1918 | Hutzelman | 248/266 |
| 1,341,535 | 5/1920 | Becker | 248/266 |
| 1,559,902 | 11/1925 | Miller | 248/270 |
| 1,613,074 | 1/1927 | Biles | 248/270 |
| 1,681,522 | 8/1928 | Damm | 248/261 |
| 1,688,563 | 10/1928 | Tomlinson | 160/301 |
| 1,882,592 | 10/1932 | Hendrickson | 160/326 |
| 2,106,073 | 1/1938 | Stuber | 464/184 |
| 2,242,683 | 5/1941 | Scott | 248/266 |
| 2,399,001 | 4/1946 | Chilton | 248/261 X |
| 3,279,529 | 10/1966 | Smith | 160/323.1 |
| 3,521,694 | 7/1970 | Anderson | 160/323.1 |
| 3,853,170 | 12/1974 | Barettella | 160/323.1 |
| 4,140,294 | 2/1979 | Zwarts | 248/270 |
| 4,373,569 | 2/1983 | Barettella | 160/263 |
| 5,230,494 | 7/1993 | Adams | 160/903 X |

*Primary Examiner*—David M. Purol

*Attorney, Agent, or Firm*—Matthews, Collins, Shepherd and Gould

[57] ABSTRACT

The present invention is an instant screen door. It has a closure on a roller or rod with attached brackets that position the closure at a minimal distance from the wall, outside the frame, and at the top or above the frame, so that the closure covers the frame completely and closely, thus making it useful for barring insects, light or visibility (for privacy) since the closure may be opaque, transparent, paneled, solid or latticed. My instant screen door can be easily and quickly mounted without marring the frame and readily removed for storage or for transfer. A user simply compresses the brackets, inserts the present invention in the frame, and releases the compression. Then, an expansive pressure assembly located inside the roller or rod forces the attached non-marring brackets into static frictional engagement with the stiles of the frame. The present invention can be mounted on frames of different types and widths because its rod or roller can be telescopic and its brackets provide three dimensional adjustability: the distance between the brackets can be increased, the height of the roller or rod can be increased, and the position at which the brackets contact the stiles can be adjusted to various depths within the frame. Two practical uses would be as an inexpensive screen door to the outside or as an opaque closure for an interior archway. It would be particularly useful for apartment dwellers who are prohibited from defacing their building.

23 Claims, 16 Drawing Sheets

INSTANT SCREEN DOOR

BACKGROUND OF THE INVENTION

1. Field of the Invention

The present invention relates generally to closures on rollers and rods with supporting brackets, and specifically to closures on roller and rod assemblies that are supported resiliently and frictionally on a frame by attached extensible brackets.

2. Description of Related Art

There is a long and broad history of related art relating to closures supported on rollers and rods, but these devices do not address the unique problems of quickly mounting a rod or roller to support a screen closure for a door frame instead of a window frame. For example, to cover a door frame, the rod or roller must be positioned at the top or above the frame, outside the frame, and very close to the plane of the wall in order to completely cover the frame to bar insects, light or visibility (for privacy). Window shade rollers were typically not designed to bar insects from passing through the frame, so in most cases their supporting brackets were made to position the roller on the window sash or between the stiles of a window frame. Also, for almost instantaneous mounting and removal of a screen closure for a door frame, the roller or rod should be supported by brackets pressured into fixed frictional engagement with the stiles of the frame, and, to ensure a fit for a variety of frame types and widths, the roller or rod should be telescopic and the brackets should be adjustable in three dimensions.

More specifically, the known closures supported on rollers and rods each suffer from one or more of the following disadvantages which make them unsuitable as instant screen doors: (a) the brackets are not extensible in all three dimensions to fit a range of frame types and widths; (b) the brackets mar the frame; (c) the brackets are not easily portable to a different frame; (d) the roller or rod assembly requires separate brackets that may be cumbersome and time-consuming to install; (e) the brackets are designed to be supported on a sliding window sash; or (f) the brackets position the roller or rod between the stiles, below the top of the frame, or not very close to the plane of wall, so insects or light may pass between the attached closure and the top of the frame, between the attached closure and the stiles, or between the attached closure and the plane of the wall.

Although some known closures on roller and rod assemblies are adjustably mounted and supported resiliently and frictionally on a frame by attached brackets, these devices are not suitable as instant screen doors because they suffer from one or more of the following additional disadvantages: (a) the expansive support pressure is effected by resilient parts that are less effective than a spring; (b) the device providing expansive support pressure is part of an additional component, another rod assembly, which is different than the roller or rod assembly which supports the closure; (c) the roller or rod is not telescopic; (d) the expansive support pressure is conducted through a roller, and consequently a conventional winding motor assembly is not effective without adding a part to it in order to counteract the detrimental expansive force exerted upon it; or (e) there is no way to vary the tension of the resilient part, usually a spring, used to effect the expansive pressure, and thus the force of the resilient part may not be sufficient to maintain the brackets in fixed frictional engagement with the stiles of the frame.

A detailed description of the disadvantages of specific related art follows.

The Curtain Fixture in U.S. Pat. No. 0,567,466 to Girouard, Sep. 8, 1896, and the Curtain Pole Holder in U.S. Pat. No. 0,999,675 to Schmitz, Aug. 1, 1911, describe curtain fixtures with brackets that provide pressurized frictional support on the stiles of a window frame. The pressure is not effected by a spring, but instead by the helical compression of two oppositely threaded bracket rods screwed together. The axes of these rods, and the direction of their axial expansive forces, intersect the stiles of the window frame. A disadvantage of both inventions is that they require another discrete rod, with an axis different than that of the two oppositely threaded bracket rods, to attach the curtain. Also, these patents do not describe ways for adjusting the height of the rod or for adjusting the depth at which the brackets contact the stiles of the window frame.

The Adjustable Curtain Support in U.S. Pat. No. 1,681,522 to Damm, Aug. 21, 1928, describes a curtain fixture with brackets that provide pressurized frictional support on the stiles of a window frame. The pressure is not effected by a spring, but instead by a pawl and lever assembly which urges two coaxial rods apart. The axes of these rods, and the direction of their axial forces, intersect the stiles of the window frame. A disadvantage is that another discrete rod, with an axis different than that of the two coaxial rods, is required to attach the curtain. Also, U.S. Pat. No. 1,681,522 does not describe means for adjusting the height of the rod or for adjusting the depth at which the brackets contact the stiles of the window frame. Moreover, the positioning of the curtain fixture does not allow the curtain to completely cover the periphery of the window frame.

The Window Shade or Curtain Holder in U.S. Pat. No. 2,242,683 to Scott, May 20, 1941, describes a window shade or curtain holder with brackets that provide spring pressurized frictional support on the stiles of a window frame. The spring force urges two coaxial rods outward. The axes of these rods, and the direction of their axial forces, intersect the stiles of the window frame. A disadvantage is that another discrete rod or roller, with an axis different than that of the two coaxial rods, is required to attach the curtain or shade. Also, U.S. Pat. No. 2,242,683 does not describe means for adjusting the height of the rod or roller or for adjusting the depth at which the brackets contact the stiles of the window frame.

The Window-Curtain Roller in U.S. Pat. No. 0,473,990 to B. Wilkinson, May 3, 1892, describes a shade roller that uses the force of an internal spring to effect pressurized frictional support on the stiles of a window frame. The brackets are not extensible, the shade does not completely cover the periphery of the window frame, and the roller is not telescopic.

The Shade Roller Apparatus in U.S. Pat. No. 3,853,170 to Barettella, Dec. 10, 1974 and the Window Shade Roller Assembly in U.S. Pat. No. 4,373,569 to Barettella, Feb. 14, 1983, each describe a shade roller that uses the force of an internal spring to effect pressurized frictional support on the stiles of a window frame. The roller is not telescopic, the brackets are not extensible, and the roller cannot be positioned outside the periphery of the window frame so the shade can completely cover the frame. Also, the force of the expansive pressure spring indirectly exerts force upon the roller's conventional winding motor assembly, and such pressure may inhibit the proper functioning of the winding motor. U.S. Pat. No. 4,373,569 adds a bearing to the winding motor assembly to mitigate such pressure. An additional disadvantage of U.S. Pat. No. 3,853,170 is that it does not provide a way to vary the tension of the expansive pressure spring.

SUMMARY OF THE INVENTION

The present invention is an instant screen door. It has a closure on a roller or rod with attached brackets that position the closure at a minimal distance from the wall, outside the frame, and at the top or above the frame, so that the closure covers the frame completely and closely, thus making it useful to bar insects, light or visibility (for privacy) since the closure may be opaque, transparent, paneled, solid or latticed. The present invention can be mounted on frames of different types and widths because its brackets are extensible in three dimensions and the rod or roller can be telescopic. My instant screen door can be easily and quickly mounted without marring the frame and readily removed for storage or for transfer. A user simply compresses the brackets, inserts the present invention in the frame, and releases the compression. Then, an expansive pressure assembly located inside the roller or rod forces the attached non-marring brackets into static frictional engagement with the stiles of the frame. Two practical uses would be as a screen door to the outside or as an opaque closure for an interior archway. It would be particularly useful for apartment dwellers who are prohibited from defacing their building.

The present invention has many technical advantages over related art. It has a unified assembly, a single roller, rod, telescoping roller or telescoping rod, which not only serves as the part for attaching and operating the closure, but also includes an internal assembly for providing expansive pressure to force attached brackets into static frictional engagement with the stiles of the frame. My instant screen door positions the roller or rod outside the periphery of the frame, so that the closure closely covers the entire frame, rather than positioning the closure within the frame whereby insects or light could enter through the space between the vertical edges of the closure and the stiles. The present invention has three dimensional adjustability: the distance between the brackets can be increased, the height of the roller or rod can be increased, and the position at which the brackets contact the stiles can be adjusted to various depths within the frame. My instant screen door can support a screen roller controlled by a conventional winding motor because the present invention's expansive force, for supporting the brackets, is not conducted along the roller or rod, and thus a conventional winding motor does not require an additional part to prevent the expansive force from inhibiting the proper functioning of the winding motor. Finally, the present invention provides a way to vary the tension of the expansive pressure spring to ensure that there is sufficient force to support the brackets.

My instant screen door has many advantages over a conventional screen door. The present invention is less expensive, quieter and easier to install. It does not require brackets or hinges with parts, such as screws or prongs, that deface the frame. It can be easily removed and transported, perhaps when the user moves to a new home. It can be used temporarily, perhaps as a screen door for a user who has an ornate front door that should not be blocked permanently by a hinged or framed screen door. Unlike a conventional screen door, the present invention uses a compliant closure which cannot smash the fingers of very young children as they pass through the doorway. An apartment dweller, who cannot install traditional screen doors because of restrictions in the lease or because the cost is prohibitive, may choose to mount my instant screen door instead of running an expensive air conditioner because, in addition to the air flow through open windows, he or she could obtain adequate cooling of his or her dwelling via the air flow through a doorway covered by a latticed closure on the present invention.

Further objects and advantages of the present invention will become apparent from a consideration of the drawings and ensuing descriptions.

REFERENCE NUMERALS IN DRAWINGS

Figure 1:
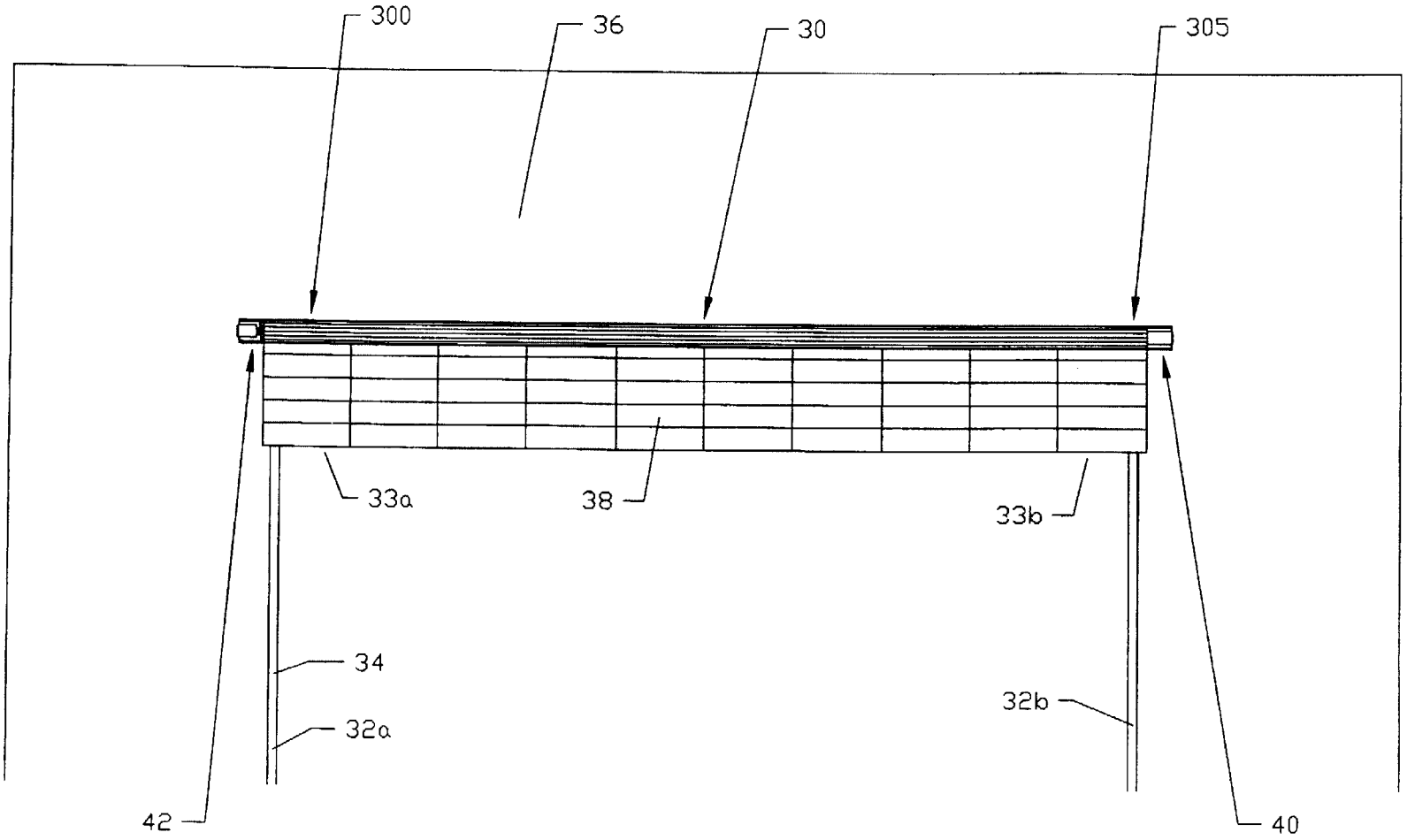
FIG. 1 is a perspective view of the front of the present invention mounted on a frame.

| NUM. | PART NAME | FIGS. |
|---|---|---|
| 30 | closure assembly | FIG. 1, 13 |
| 32a | stile | FIG. 1, 12 |
| 32b | stile | FIG. 1, 12 |
| 33a | corner | FIG. 1 |
| 33b | corner | FIG. 1 |
| 34 | frame | FIG. 1, 12, 13 |
| 36 | wall | FIG. 1, 12 |
| 38 | closure | FIG. 1, 3, 16 |
| 40 | first bracket assembly | FIG. 1, 2, 3, 7, 11 |
| 42 | second bracket assembly | FIG. 1, 2, 10 |

-continued

REFERENCE NUMERALS IN DRAWINGS

Figure 2:
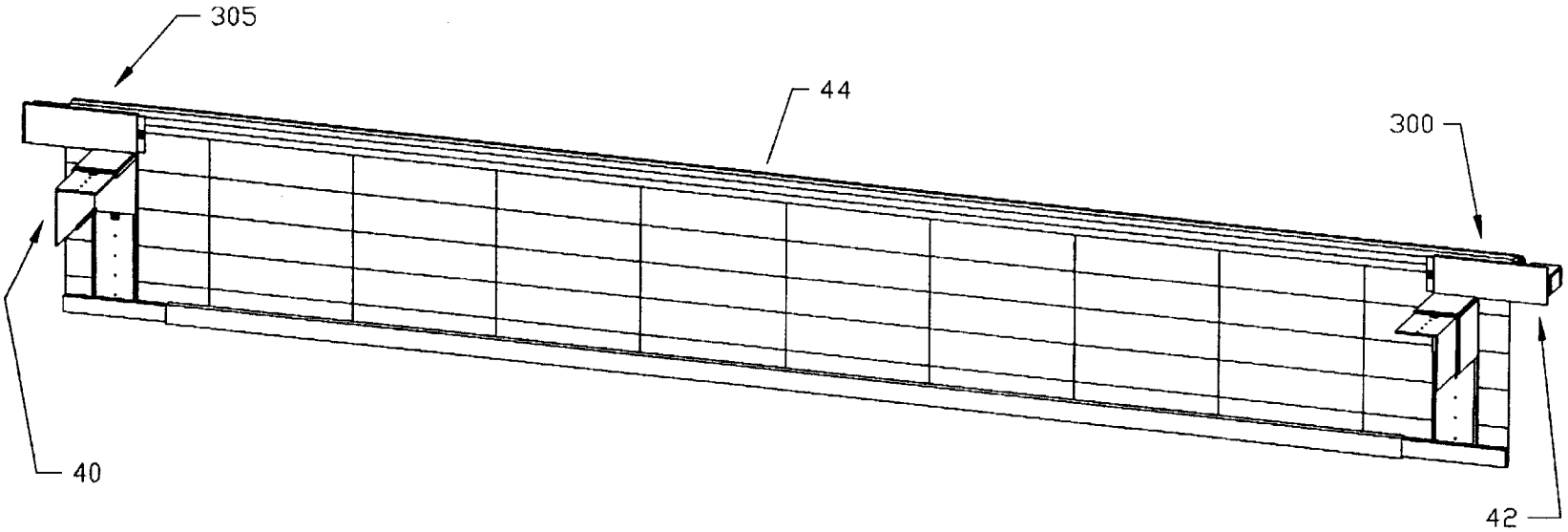
FIG. 2 is an isometric view of the back of the present invention when it is dismounted and isolated from the frame.
Figure 3:
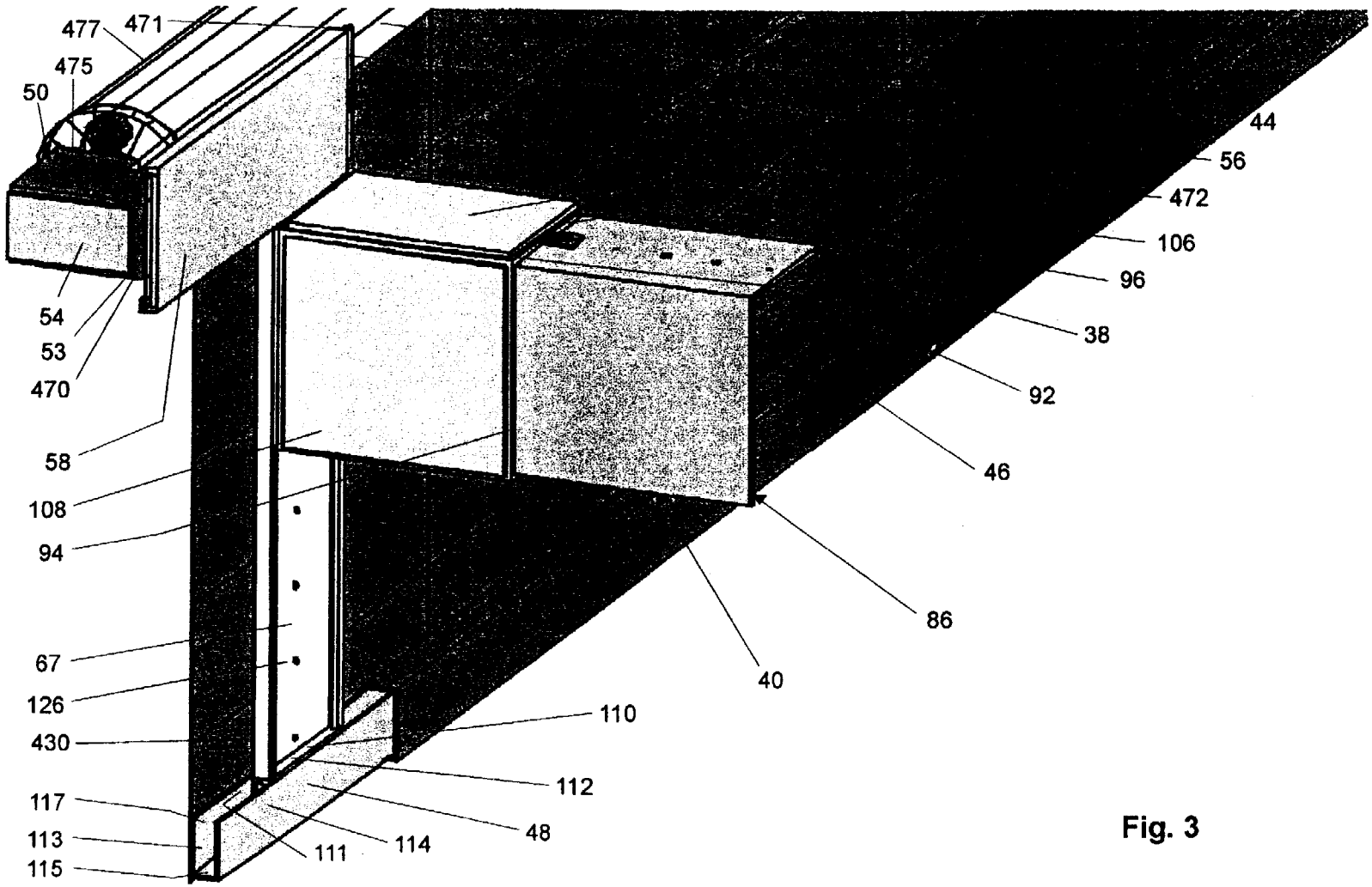
FIG. 3 is a perspective view of the back of one side of the present invention.
Figure 4:
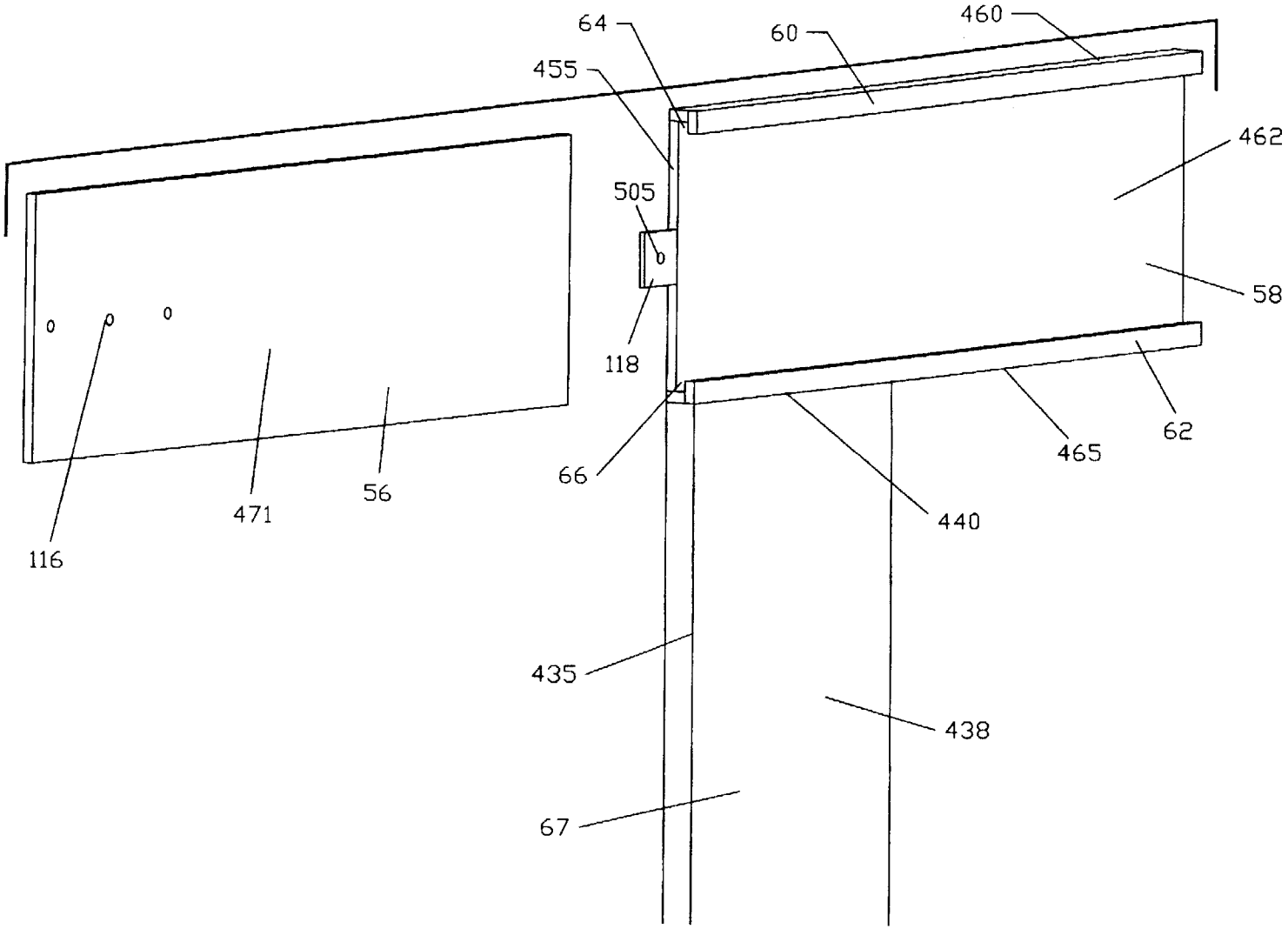
FIG. 4 is an enlarged and exploded perspective view of the present invention's parts that allow the distance between the brackets to be adjusted to fit the particular width of a frame.
Figure 5:
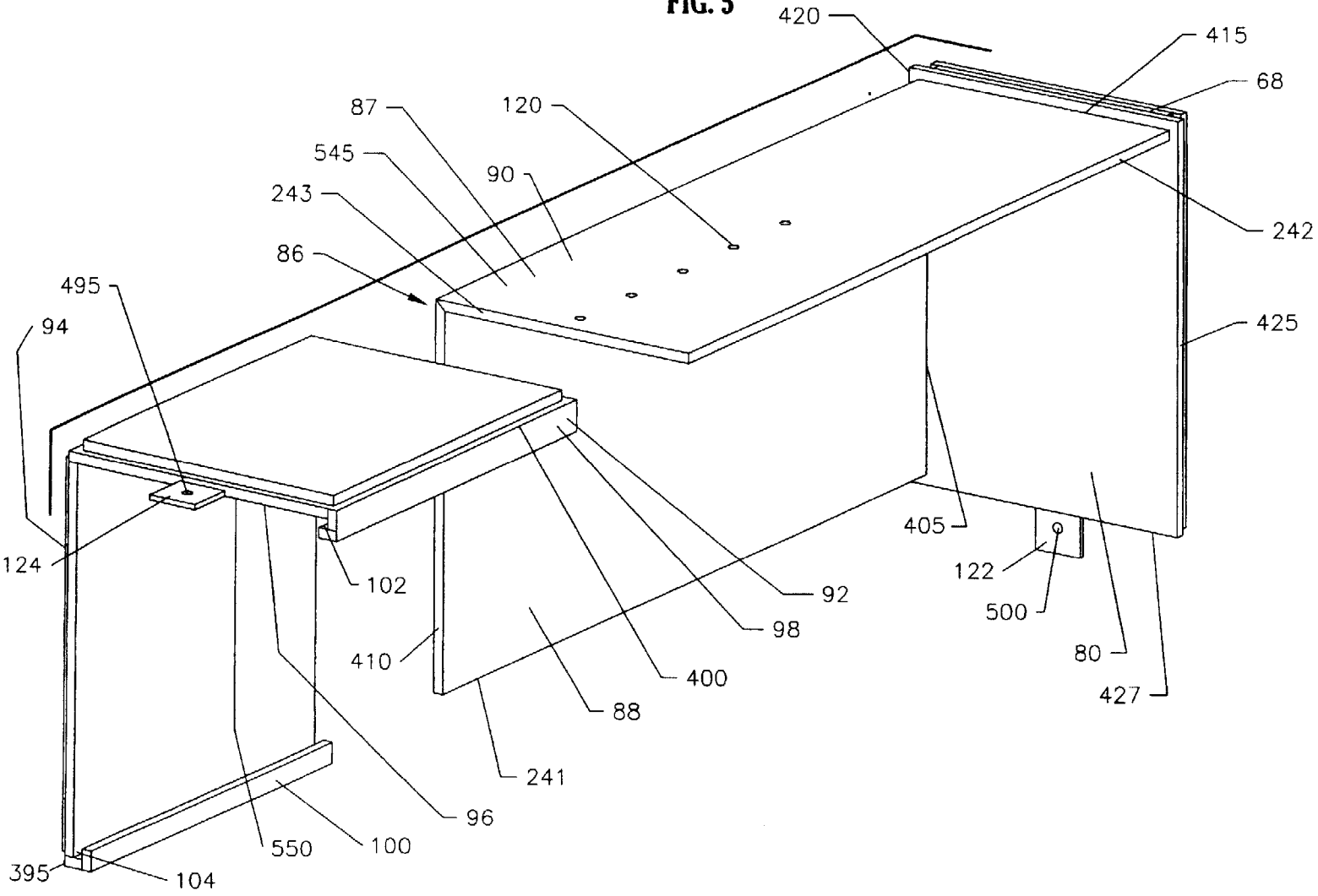
FIG. 5 is an enlarged and exploded isometric view of the present invention's parts that allow for adjustment of the depth of the position at which the brackets contact the stiles of the frame.
Figure 6:
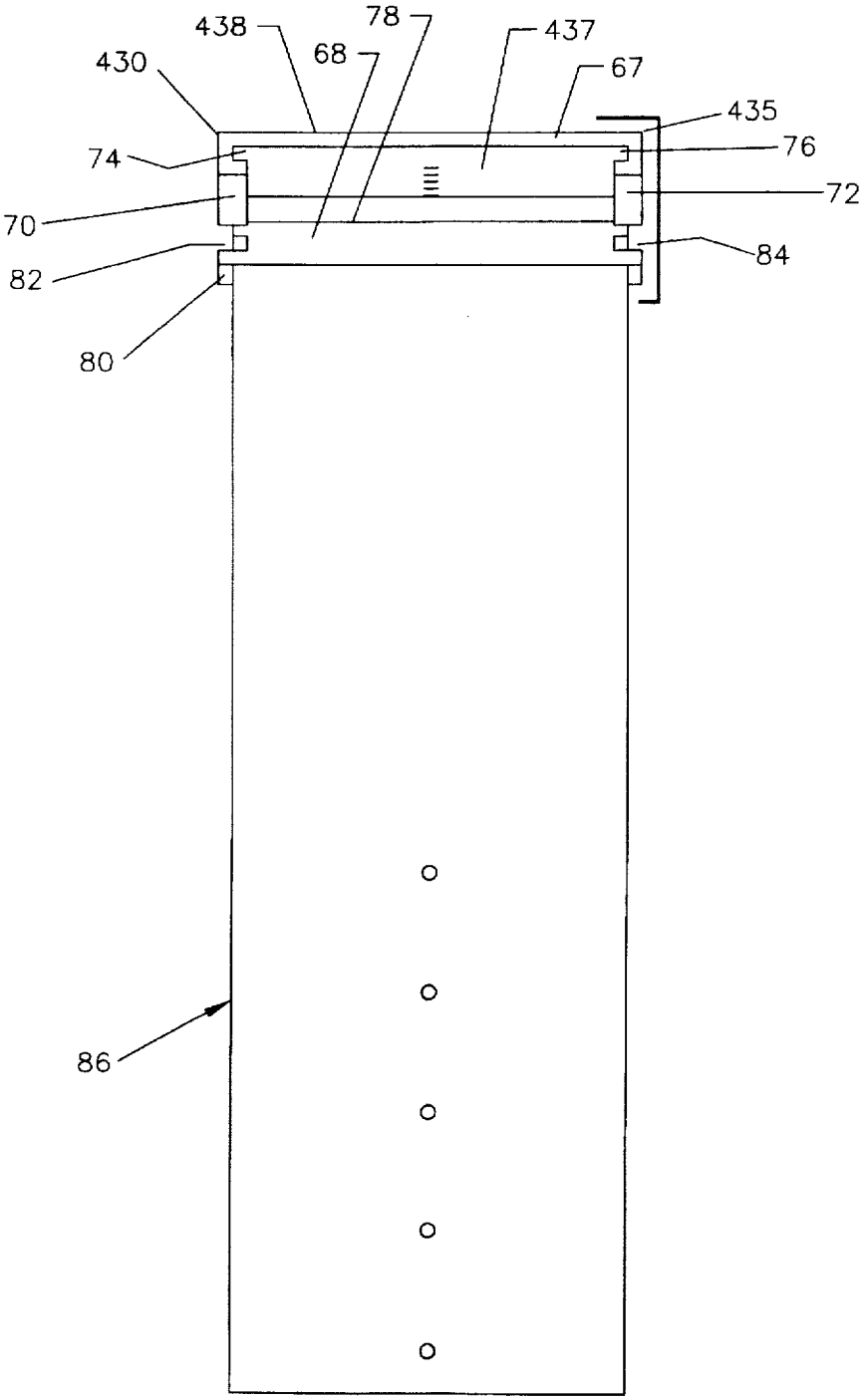
FIG. 6 is an enlarged and exploded downward view of the present invention's parts that allow the position of the roller rod to be adjusted vertically.
Figure 7:
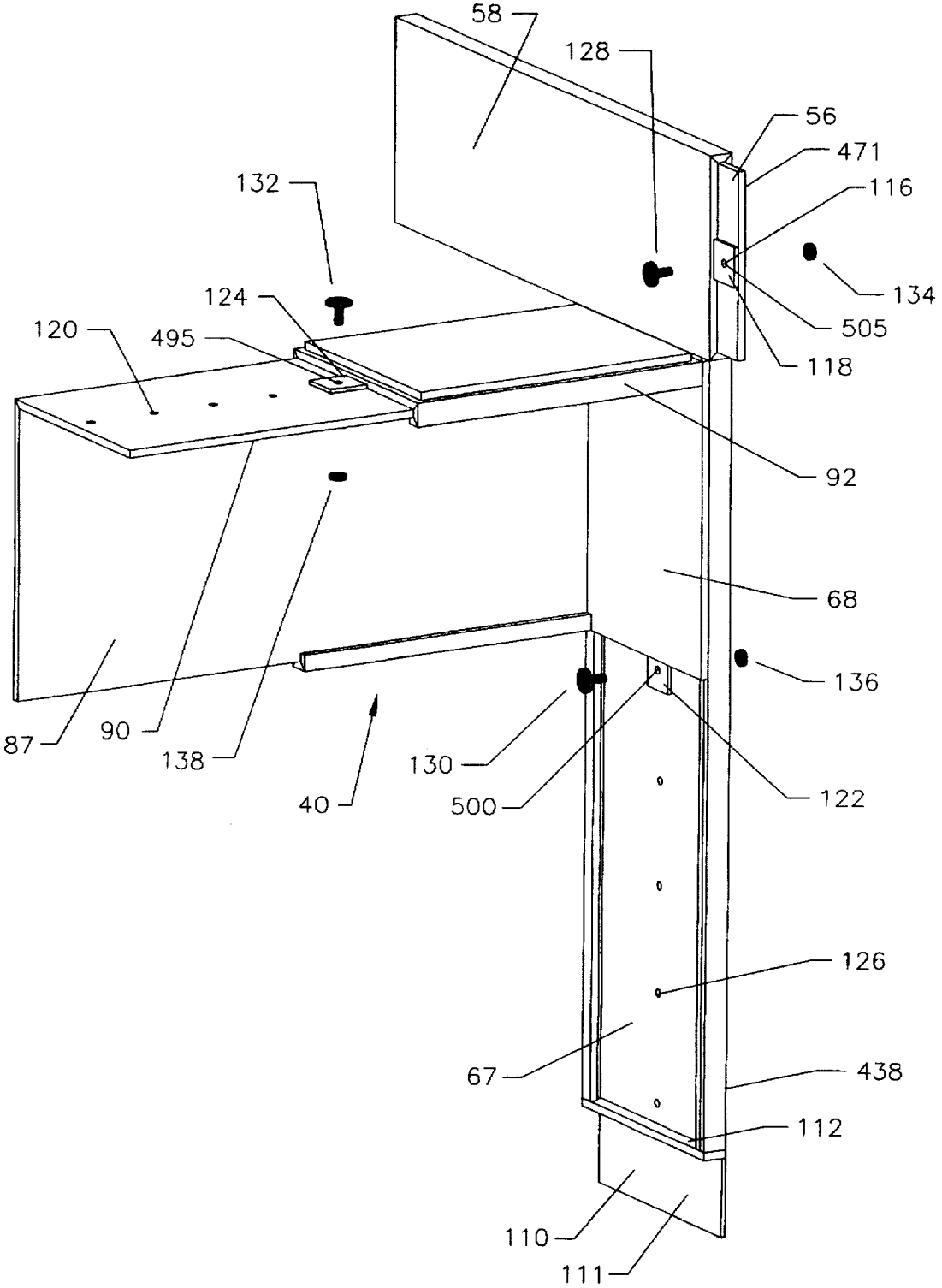
FIG. 7 is a perspective view of one of the brackets of the present invention without the roller rod and with an exploded view of screws and nuts used to secure the adjusted position of the bracket.
Figure 8:
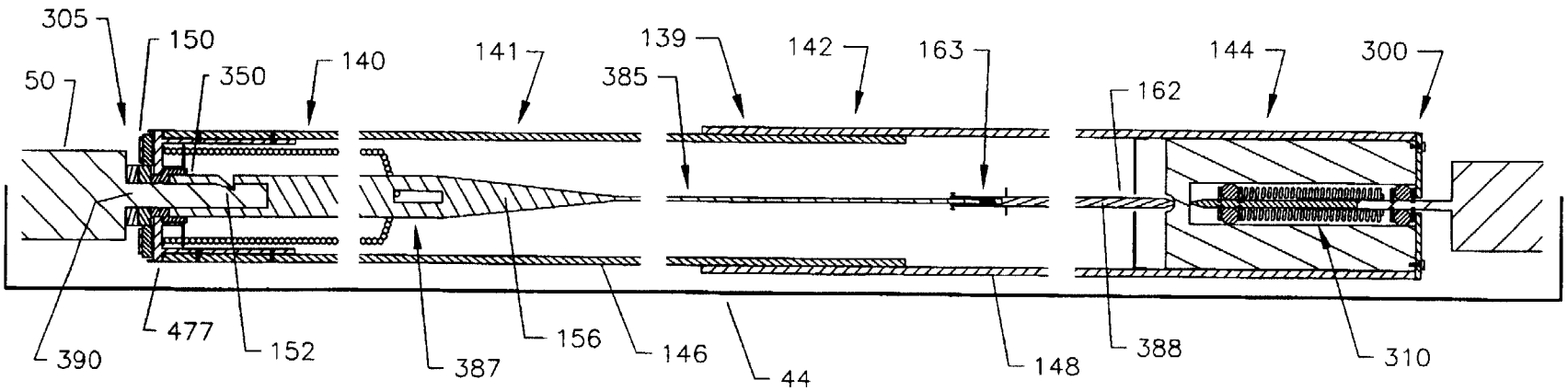
FIG. 8 is a foreshortened section view of the present invention's roller rod assembly.
Figure 10:
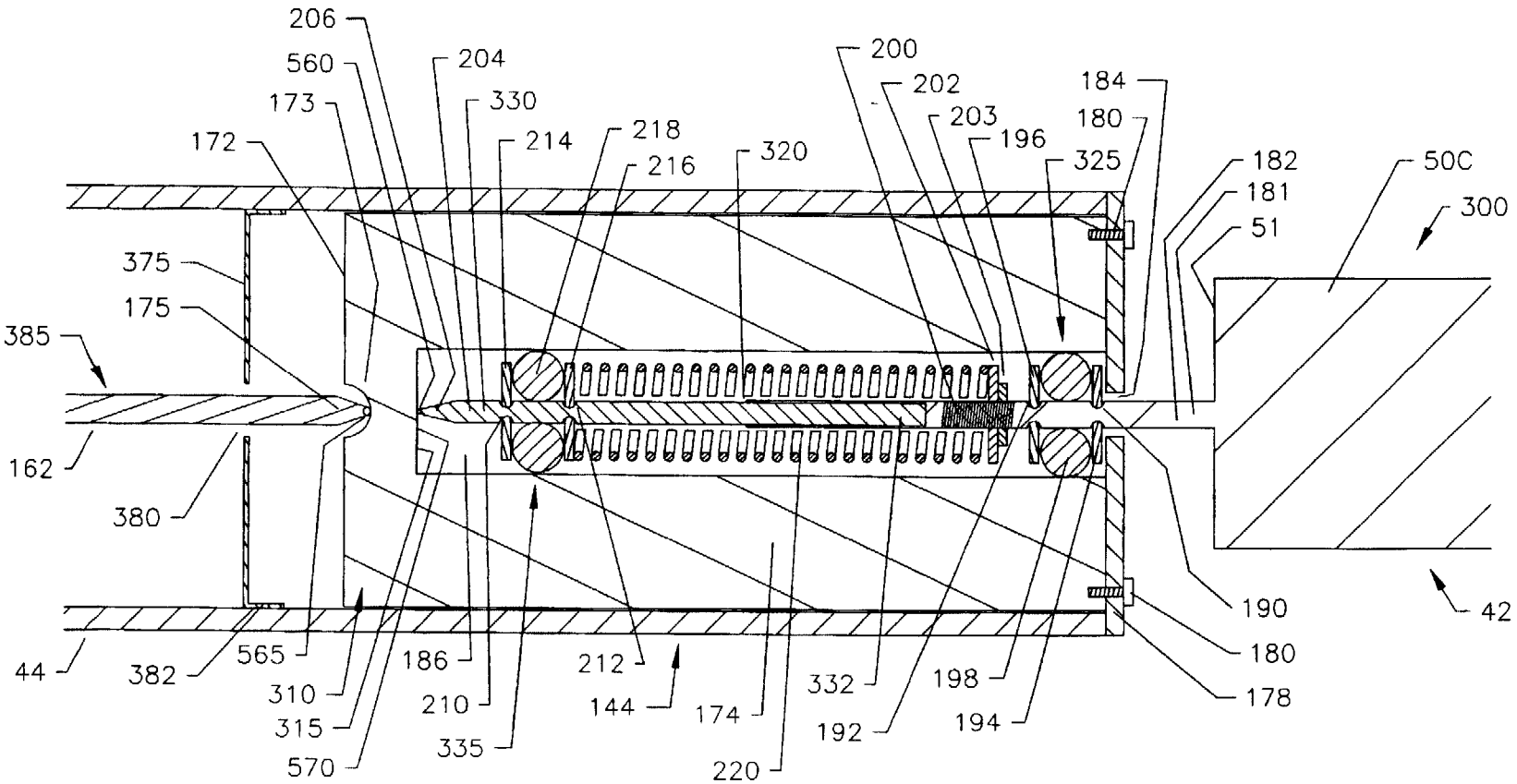
FIG. 10 is a section view of the present invention's roller rod on the side having an expansive pressure assembly.

| NUM. | PART NAME | FIGS. |
|---|---|---|
| 44 | roller rod | FIG. 2, 3, 8, 10 |
| 46 | slat pocket | FIG. 3 |
| 48 | slat | FIG. 3 |
| 50 | intermediate member | FIG. 3, 8 |
| 51 | surface | FIG. 10 |
| 53 | side | FIG. 3 |
| 54 | palm pad | FIG. 3 |
| 56 | transverse member | FIG. 3, 4, 7, 11 |
| 58 | lateral extension member | FIG. 3, 4, 7, 11 |
| 60 | guide flange | FIG. 4 |
| 62 | guide flange | FIG. 4 |
| 64 | guideway | FIG. 4 |
| 66 | guideway | FIG. 4 |
| 67 | upright member | FIG. 3, 4, 6, 7, 11, 16 |
| 68 | upright interlocking member | FIG. 5, 6, 7 |
| 70 | guide flange | FIG. 6 |
| 72 | guide flange | FIG. 6 |
| 74 | guideway | FIG. 6 |
| 76 | guideway | FIG. 6 |
| 78 | inner face | FIG. 6 |
| 80 | outer face | FIG. 5, 6 |
| 82 | guideway | FIG. 6 |
| 84 | guideway | FIG. 6 |
| 86 | vertical extension assembly | FIG. 3, 5, 6, 11 |
| 87 | arm | FIG. 5, 7, 11, 14, 15 |
| 88 | vertical planar portion | FIG. 5 |
| 90 | horizontal planar portion | FIG. 5, 7, 14, 15 |
| 92 | depth extension member | FIG. 3, 5, 7, 11, 14, 15 |
| 94 | vertical plate portion | FIG. 3, 5 |
| 96 | horizontal plate portion | FIG. 3, 5, 14, 15 |
| 98 | guide flange | FIG. 5 |
| 100 | guide flange | FIG. 5 |
| 102 | guideway | FIG. 5 |
| 104 | guideway | FIG. 5 |
| 106 | frame pad | FIG. 3 |
| 108 | frame pad | FIG. 3 |
| 110 | catch | FIG. 3, 7 |
| 111 | vertical portion | FIG. 3, 7 |
| 112 | horizontal portion | FIG. 3, 7 |
| 113 | first planar portion | FIG.3 |
| 114 | second planar portion | FIG. 3 |
| 115 | third planar portion | FIG. 3 |
| 116 | series of holes | FIG. 4, 7, 11 |
| 117 | slat cavity | FIG.3 |
| 118 | tab | FIG. 4, 7, 11 |
| 120 | series of holes | FIG. 5, 7, 11 |
| 122 | tab | FIG. 5, 7, 11 |
| 124 | tab | FIG. 5, 7, 11 |
| 126 | series of holes | FIG. 3, 7, 11 |
| 128 | screw | FIG. 7, 11 |
| 130 | screw | FIG. 7, 11 |
| 132 | screw | FIG. 7, 11 |
| 134 | nut | FIG. 7 |
| 136 | nut | FIG. 7 |
| 138 | nut | FIG. 7, 11 |
| 139 | telescoping roller | FIG. 8 |
| 140 | first portion | FIG. 8 |
| 141 | second portion | FIG. 8 |
| 142 | third portion | FIG. 8 |
| 144 | fourth portion | FIG. 8, 10 |
| 146 | underlying roller rod | FIG. 8 |
| 148 | overlaying roller rod | FIG. 8 |
| 150 | conventional winding motor assembly | FIG. 8 |
| 152 | pintle | FIG. 8 |
| 156 | spring guide shaft | FIG. 8 |
| 162 | conductive shaft interior end | FIG. 8, 10 |
| 163 | conductive shaft extension assembly | FIG. 8, 9 |
| 172 | housing end surface | FIG. 10 |
| 173 | hemispherical recess | FIG. 10 |
| 174 | housing | FIG. 10 |
| 175 | housing bearing | FIG. 10 |
| 178 | cap | FIG. 10 |
| 180 | screws | FIG. 10 |
| 181 | forward shaft exterior end | FIG. 10 |
| 182 | forward shaft | FIG. 10 |
| 184 | cap aperture | FIG. 10 |

-continued

REFERENCE NUMERALS IN DRAWINGS

Figure 9:
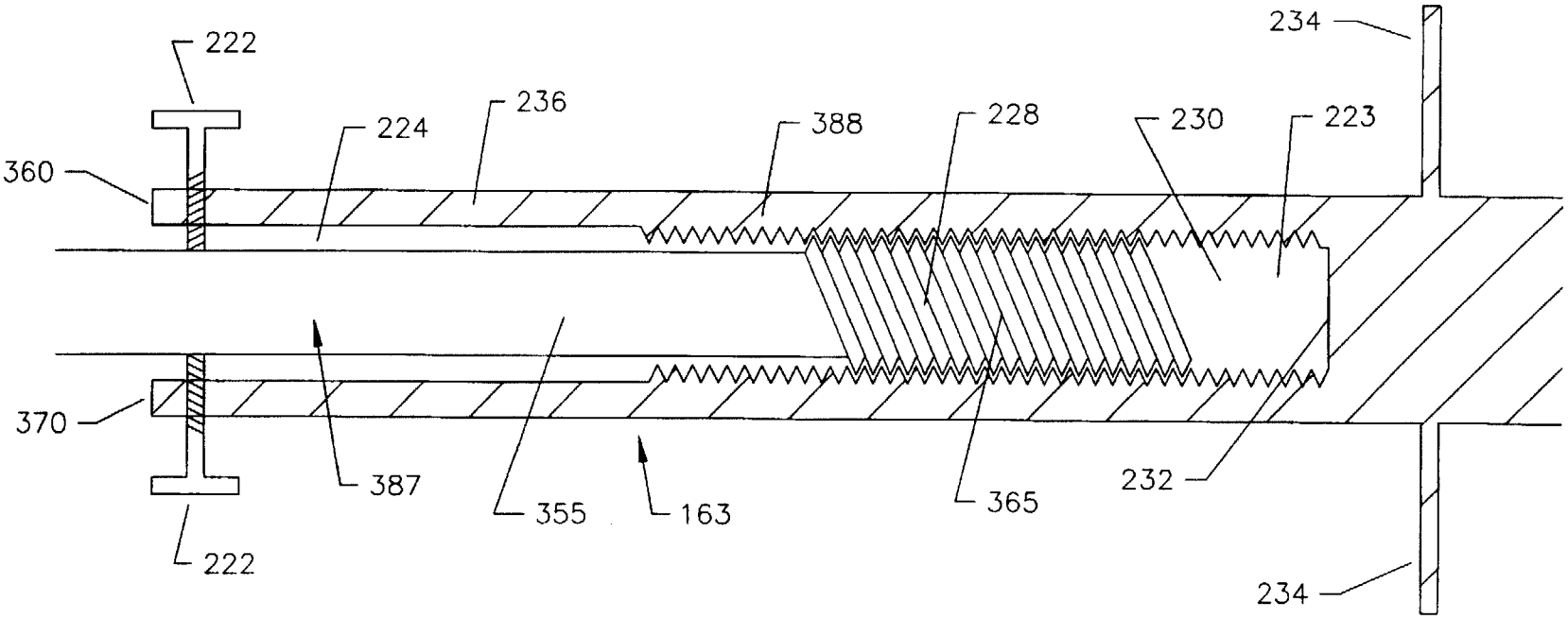
FIG. 9 is an enlarged section view of portions of the roller rod assembly's parts that permit adjustment and maintenance of the roller rod's length.
Figure 12:
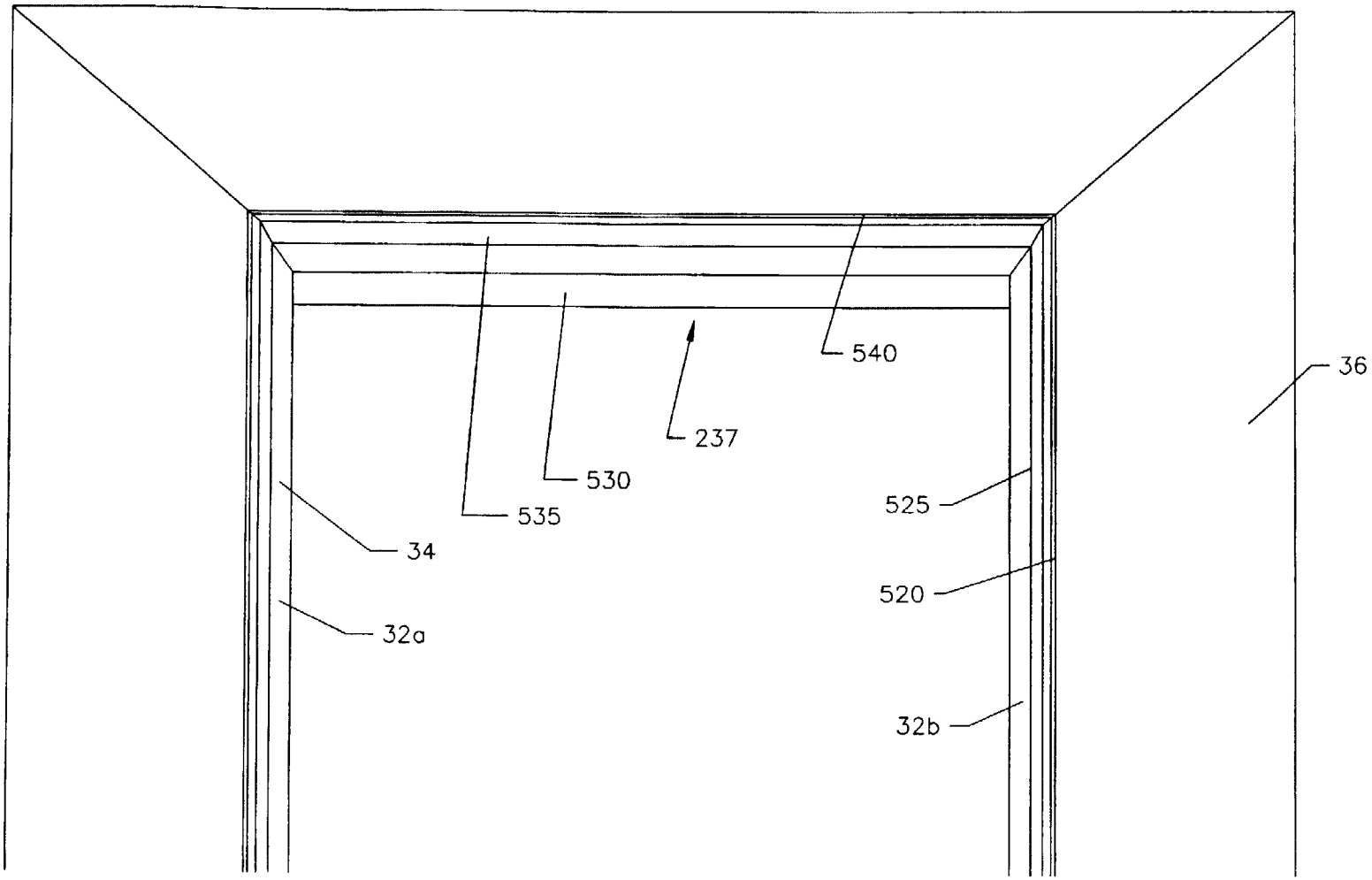
FIG. 12 is an perspective view of a certain type of frame, which is referred to as a "multi-plane frame".
Figure 14:
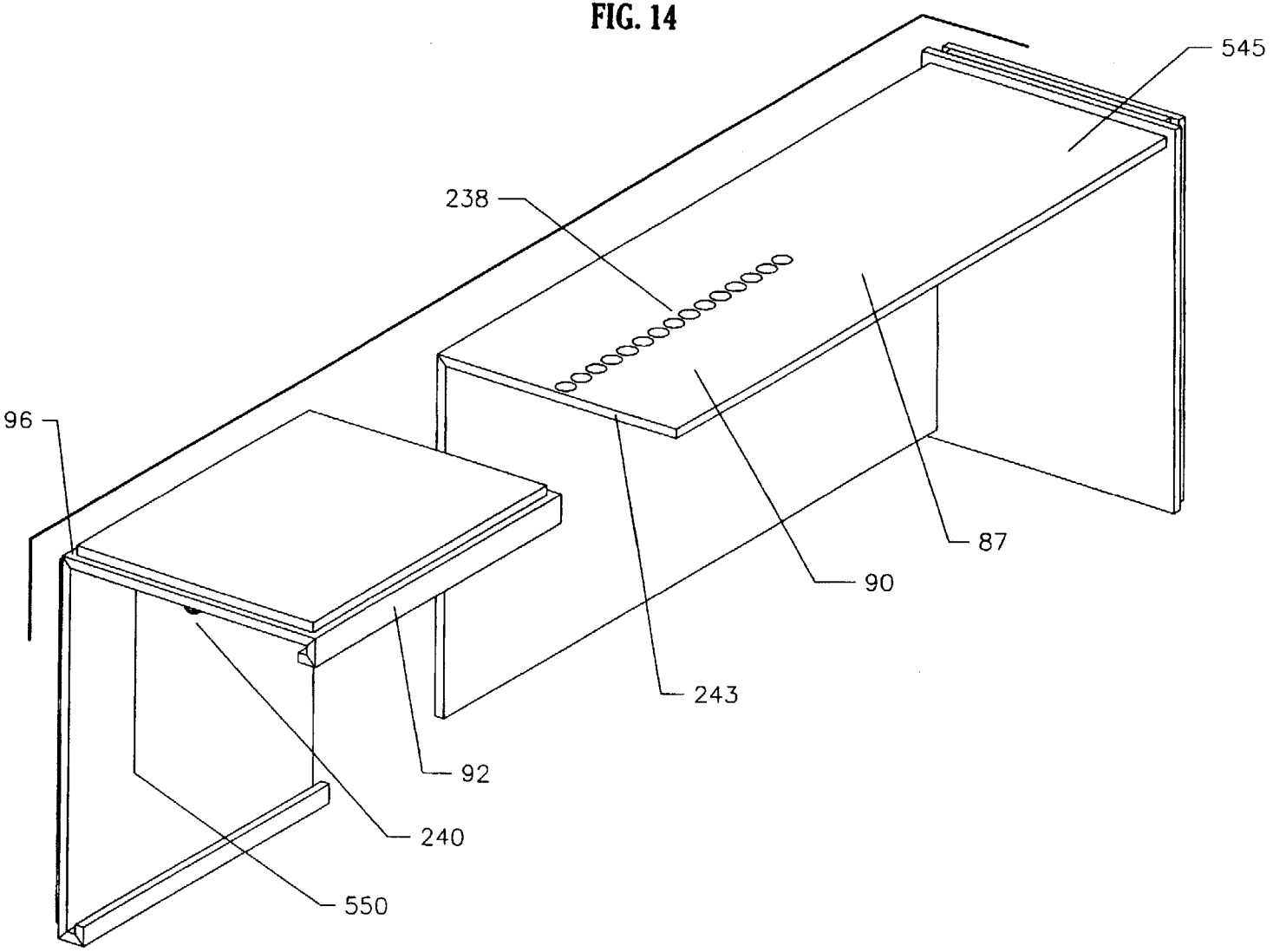
FIG. 14 is an enlarged isometric view of an embodiment of the present invention's parts which use a lug for fixing the adjustment of the depth of the position at which the brackets contact the frame.
Figure 15:
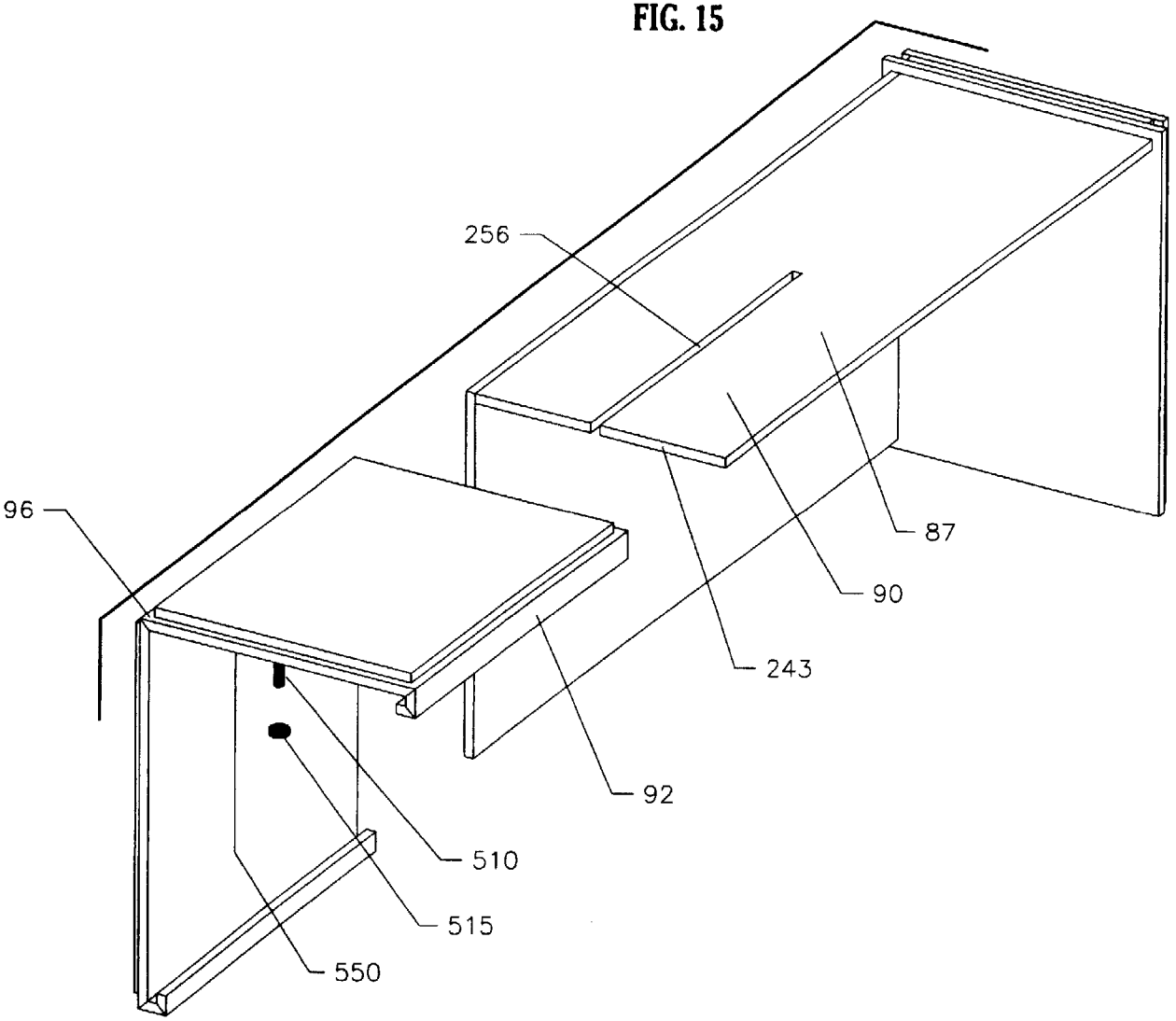
FIG. 15 is an enlarged isometric view of an embodiment of the present invention's parts which use a screw, mated nut and slot for fixing the adjustment of the depth of the position at which the brackets contact the stiles of the frame.
Figure 16:
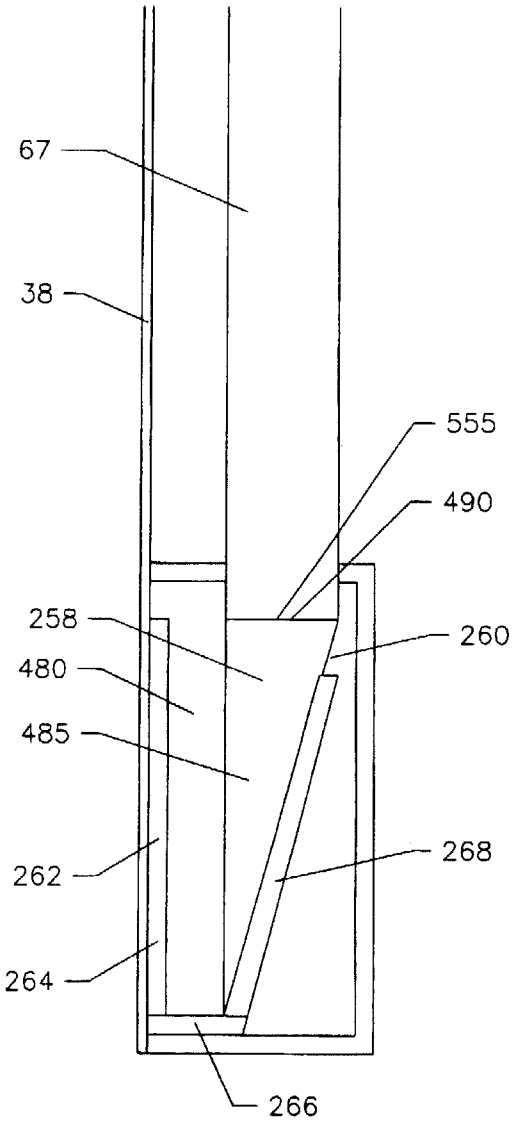
FIG. 16 is an enlarged elevation side view of an embodiment of the present invention's bottom portion showing a triangular catch for securing a slat held in a pocket at the bottom of the closure.

| NUM. | PART NAME | FIGS. |
|---|---|---|
| 186 | housing cavity | FIG. 10 |
| 190 | groove | FIG. 10 |
| 192 | groove | FIG. 10 |
| 194 | snap ring | FIG. 10 |
| 196 | snap ring | FIG. 10 |
| 198 | roller bearing | FIG. 10 |
| 200 | threads | FIG. 10 |
| 202 | spring stop | FIG. 10 |
| 203 | locking element | FIG. 10 |
| 204 | rearward shaft | FIG. 10 |
| 206 | base bearing | FIG. 10 |
| 210 | groove | FIG. 10 |
| 212 | groove | FIG. 10 |
| 214 | snap ring | FIG. 10 |
| 216 | snap ring | FIG. 10 |
| 218 | roller bearing | FIG. 10 |
| 220 | spring | FIG. 10 |
| 222 | primary shaft securing screws | FIG. 9 |
| 223 | cavity | FIG. 9 |
| 224 | unthreaded cavity portion | FIG. 9 |
| 228 | threaded end | FIG. 9 |
| 230 | threaded cavity portion | FIG. 9 |
| 232 | cavity closed base | FIG. 9 |
| 234 | handles | FIG. 9 |
| 236 | secondary shaft engaged portion | FIG. 9 |
| 237 | multi-plane frame | FIG. 12 |
| 238 | series of recesses | FIG. 14 |
| 246 | lug | FIG. 14 |
| 241 | bottom edge | FIG. 5 |
| 242 | top edge | FIG. 5 |
| 243 | second horizontal edge | FIG. 5, 14, 15 |
| 256 | slot | FIG. 15 |
| 258 | catch | FIG. 16 |
| 260 | slanted surface | FIG. 16 |
| 262 | slat | FIG. 16 |
| 264 | first planar portion | FIG. 16 |
| 266 | third planar portion | FIG. 16 |
| 268 | second planar portion | FIG. 16 |
| 300 | closure assembly first end | FIG. 1, 2, 8, 10 |
| 305 | closure assembly second end | FIG. 1, 2, 8 |
| 310 | expansive pressure assembly | FIG. 8, 10 |
| 315 | housing cavity base | FIG. 10 |
| 320 | forward shaft open end | FIG. 10 |
| 325 | forward shaft axial bearing assembly | FIG. 10 |
| 330 | rearward shaft projecting portion | FIG. 10 |
| 332 | rearward shaft underlying portion | FIG. 10 |
| 335 | rearward shaft axial bearing assembly | FIG. 10 |
| 350 | conventional link | FIG. 8 |
| 355 | primary shaft engaged portion | FIG. 9 |
| 360 | secondary shaft base | FIG. 9 |
| 365 | threads | FIG. 9 |
| 370 | cavity opening | FIG. 9 |
| 375 | guide disk | FIG. 10 |
| 380 | guide disk aperture | FIG. 10 |
| 382 | flanged rim | FIG. 10 |
| 385 | conductive shaft | FIG. 8, 10 |
| 387 | primary shaft assembly | FIG. 8, 9 |
| 388 | secondary shaft | FIG. 8, 9 |
| 390 | conductive shaft exterior end | FIG. 8 |
| 395 | first outer edge | FIG. 5 |
| 400 | second outer edge | FIG. 5 |
| 405 | first vertical edge | FIG. 5 |
| 410 | second vertical edge | FIG. 5 |
| 415 | first horizontal edge | FIG. 5 |
| 420 | first vertical edge | FIG. 5 |
| 425 | second vertical edge | FIG. 5 |
| 427 | bottom horizontal edge | FIG. 5 |
| 430 | first vertical edge | FIG. 3, 6 |
| 435 | second vertical edge | FIG. 4, 6 |
| 437 | rear face | FIG. 6 |
| 438 | front face | FIG. 4, 6, 7 |
| 440 | top horizontal edge | FIG. 4 |
| 455 | vertical edge | FIG. 4 |
| 460 | top longitudinal edge | FIG. 4 |
| 462 | face | FIG. 4 |
| 465 | bottom longitudinal edge | FIG. 4 |

-continued

REFERENCE NUMERALS IN DRAWINGS

Figure 13:
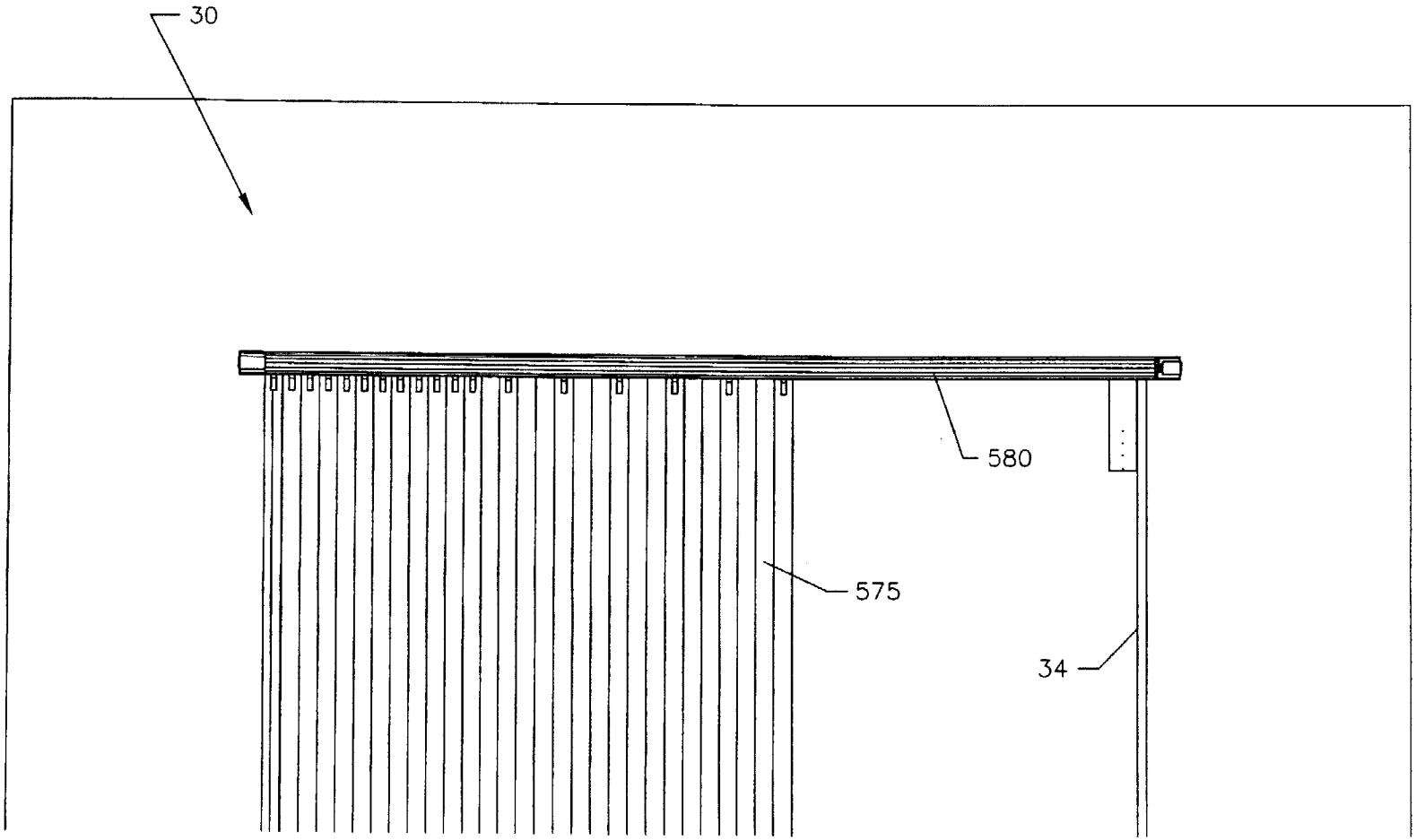
FIG. 13 is a perspective view of the front of an embodiment of the present invention which has a closure hanging from a rod supported on the frame.

| NUM. | PART NAME | FIGS. |
|---|---|---|
| 470 | intermediate member first portion | FIG. 3 |
| 471 | first surface | FIG. 3, 4, 7 |
| 472 | second surface | FIG. 3 |
| 475 | intermediate member second portion | FIG. 3 |
| 477 | roller rod end | FIG. 3, 8, 11 |
| 480 | slat cavity | FIG. 16 |
| 485 | right triangle face | FIG. 16 |
| 490 | shortest side | FIG. 16 |
| 495 | aperture | FIG. 5, 7, 11 |
| 500 | aperture | FIG. 5, 7, 11 |
| 505 | aperture | FIG. 4, 7, 11 |
| 510 | screw | FIG. 15 |
| 515 | nut | FIG. 15 |
| 520 | wall periphery | FIG. 12 |
| 525 | stile periphery | FIG. 12 |
| 530 | horizontal stile connecting member | FIG. 12 |
| 535 | connecting surface | FIG. 12 |
| 540 | wall periphery top horizontal | FIG. 12 |
| 545 | top face | FIG. 5, 14 |
| 550 | bottom face | FIG. 5, 14, 15 |
| 555 | base | FIG. 16 |
| 560 | ball bearing | FIG. 10 |
| 565 | ball bearing | FIG. 10 |
| 570 | lining | FIG. 10 |
| 575 | closure | FIG. 13 |
| 580 | rod | FIG. 13 |

DETAILED STRUCTURAL DESCRIPTION OF THE INVENTION

This section details part structures and interconnections of the preferred embodiment of the present invention. A detailed description of the operations and functions of the parts will be given in the next section.

The front of the preferred embodiment of the present invention is illustrated in FIG. 1. A closure assembly 30 is mounted on a stile 32*a* and a stile 32*b* of a wall 36's frame 34. An attached latticed closure 38 is shown in its fully open position, where it is wound up to the bottom of closure assembly 30. Closure 38 may be consumer sizable and consumer attachable to closure assembly 30. Closure 38 is a sheet which may be made of a fabric, plastic, or other suitable lightweight compliant material. Although it is shown as latticed, it may be made of a continuous material, which could be opaque or transparent. Closure 38 is long enough for its bottom edge to touch the ground or the floor in all of the possible extended positions of closure assembly 30.

FIG. 2 shows the back of the present invention's preferred embodiment when it is dismounted and isolated from frame 34. A first bracket assembly 40 is attached to a roller rod 44 at closure assembly first end 305, and a second bracket assembly 42 is attached to roller rod 44 at closure assembly second end 300. Roller rod 44 is wider than frame 34. Bracket assemblies 40 and 42 are practically symmetrical in construction. For this reason, only first bracket assembly 40 will be described in detail. When it is necessary to refer to a part on second bracket assembly 42, the part will be referred to by the same number as its counterpart on first bracket assembly 40, and a "C" will be appended to such number.

FIG. 3 shows the back of closure assembly first end 300, with closure 38 rolled up to the bottom of first bracket assembly 40. The main parts and interconnections of first bracket assembly 40 are shown. Roller rod end 477 of roller rod 44 is connected to an intermediate member 50. Intermediate member 50 is connected to a transverse member 56. Transverse member 56 is slidably received by a lateral extension member 58. An upright member 67 extends vertically downward from lateral extension member 58. A vertical extension assembly 86 slides on upright member 67. A depth extension member 92 slides on vertical extension assembly 86. These parts may be made of metal, plastic, or other suitable inexpensive moldable material. The selected material should be capable of withstanding any temperature variations resulting from a change in outdoor temperatures. It should also be resistant to discoloration from constant light exposure. The structures and interconnections of the main parts of first bracket assembly 40 will be described in greater detail below.

Intermediate member 50 is elbow-shaped. The length of intermediate member first portion 470, the arm of intermediate member 50 perpendicular to the axis of roller rod 44, determines the clearance between lateral extension member 58 and closure 38. The clearance will be less when closure 38 is rolled onto roller rod 44. First portion 470 is only long enough to provide a minimal clearance between closure 38 and lateral extension member 58. This also ensures minimal clearance between closure 38 and wall 36 (shown in FIG. 1) because lateral extension member 58 abuts wall 36 when the present invention is mounted. There is a palm pad 54 attached to an outer surface 53 of intermediate member 50. Outer surface 53 is normal to the longitudinal axis of roller rod 44. Palm pad 54 may be made of soft rubber or other suitable soft material.

Intermediate member 50 is connected to rectangular, horizontally elongated transverse member 56 which is parallel to the plane of frame 34 (shown in FIG. 1). Transverse member 56 is slidably received by rectangular lateral extension member 58. Transverse member 56 is located between lateral extension member 58 and roller rod 44. Transverse member 56 has a planar first surface 471 facing towards roller rod 44, and a planar second surface 472 facing the opposite direction. The length of transverse member 56 is slightly greater than that of lateral extension member 58. The longitudinal axes of transverse member 56 and lateral extension member are at the same level as the longitudinal axis of roller rod 44. Also, the width of transverse member 56 and the width of lateral extension member 58 are each less than the diameter of roller rod 44. Thus, someone viewing the present invention from the front will not be able to see transverse member 56 and lateral extension member 58 because these members will be hidden behind roller rod 44.

Rectangular upright member 67 extends vertically downward from the bottom of lateral extension member 58. Upright member 67 has a first vertical edge 430. First vertical edge 430 is closer to roller rod end 477 than upright member 67's other vertical edges. From the illustrated adjusted position of first bracket assembly 40, at which it has the smallest width, its maximum lateral extension is approximately equal to the horizontal distance between upright member 67's first vertical edge 430 and roller rod end 477. Upright member 67 slidably receives vertical extension assembly 86. The width of upright member 67 is slightly greater than the width of vertical extension assembly 86.

Along the vertical line of symmetry of upright member 67, there is an aligned series of holes 126 starting near the bottom of upright member 67 and extending upward to approximately the middle of upright member 67. (There are five holes 126 in the series displayed in this preferred embodiment, but there could be a greater number of holes positioned closer together or a fewer number of holes positioned farther apart.)

Elbow-shaped depth extension member 92 is slidably received on vertical extension assembly 86. Depth extension member 92 has a rectangular vertical plate portion 94, closest to upright member 67's first vertical edge 430, and a rectangular horizontal plate portion 96, closest to the top of upright member 67. Vertical plate portion 94 and horizontal plate portion 96 are disposed at a right angle to each other and normally to upright member 67. The length (the dimension normal to upright member 67) of depth extension member 92 is significantly less than the length of vertical extension assembly 86.

Horizontal plate portion 96 is covered with a frame pad 106, and vertical plate portion 94 is covered with a frame pad 108. Frame pads 106 and 108 are made of a non-marring material having a high coefficient of friction, such as a sponge rubber or other suitable material.

The bottom of closure 38 has a centered slat pocket 46. The length of slat pocket 46 is approximately the same as the distance between first bracket assembly 40 and second bracket assembly 42 (shown in FIG. 2).

A thin slat 48 is received by slat pocket 46. Slat 48 may be made of plastic or other suitable moldable material. Since roller rod 44 may be extensible and closure 38 may be consumer sizable, slat 48 may also be consumer sizable. The length of slat 48 is sized to be the same as the width of closure 38. Thus, slat 48 is longer than slat pocket 46, and portions of slat 48 extend from both ends of slat pocket 46. Slat 48 is a right-angled formation of three rectangular planar portions. It has a vertical planar portion 113 parallel and adjacent to closure 38, and it has an opposite and parallel vertical planar portion 114. Planar portions 113 and 114 are attached to opposite edges of a bottom horizontal planar portion 115. Planar portions 113, 114, and 115 form a slat cavity 117 which opens upward.

An elbow-shaped catch 110 is connected to the bottom of upright member 67. Catch 110 is a right-angled formation of two rectangular planar portions, a vertical portion 111 and a horizontal portion 112, which are best illustrated in FIG. 7. Horizontal portion 112 has the same dimensions as the bottom of upright member 67 to which it is attached. Vertical portion 111 is parallel to the plane of closure 38, and it is positioned towards the front of the present invention. The horizontal dimension of vertical portion 111 is approximately the same as the width of upright member 67. The vertical dimension of vertical portion 111 is approximately the same as slat 48's. The thickness of catch 110's vertical portion 111 is less than the width of slat cavity 117.

FIG. 4 shows transverse member 56, lateral extension member 58 and the upper portion of upright member 67 in an exploded perspective view. These parts allow the distance between bracket assemblies 40 and 42 (shown in FIG. 2) to be adjusted to fit a frame of a particular width. Lateral extension member 58 is made very thinly in order to minimize the distance between the plane of wall 36 and closure 38 (shown in FIG. 1). Lateral extension member 58 has two inwardly-turned flanges: a top horizontal guide flange 60 along top longitudinal edge 460 and a bottom horizontal guide flange 62 along bottom longitudinal edge 465. The spacing of each flange 60 and 62 is approximately the same as the thickness of transverse member 56, and such spacing forms horizontal guideways 64 and 66. Horizontal guideways 64 and 66 slidably receive transverse member 56. Transverse member 56 slides upon a face 462 of lateral extension member 58.

Along transverse member 56's horizontal line of symmetry, there is an aligned series of holes 116 starting near one vertical edge of transverse member 56 and extending to approximately the middle of transverse member 56. (There are three holes 116 in the series displayed in this preferred embodiment of the present invention, but there could be a greater number of holes positioned closer together or a fewer number of holes positioned farther apart.)

Upright member 67's top horizontal edge 440 is connected to the bottom of guide flange 62. Upright member 67 has a second vertical edge 435; it is in alignment with a vertical edge 455 of lateral extension member 58. Upright member 67's front face 438 points in the same direction as lateral extension member 58's face 462.

A thin rectangular tab 118, having an aperture 505, is secured to the middle of lateral extension member 58's vertical edge 455. Aperture 505 is in alignment with series of holes 116.

Vertical extension assembly 86 and depth extension member 92 are illustrated from an exploded isometric view in FIG. 5. These parts allow for adjustment of the depth of the position at which bracket assemblies 40 and 42 (shown in FIG. 2) contact the stiles of the frame. Vertical extension assembly 86 consists of an upright interlocking member 68, an arm 87, and a thin rectangular tab 122, having an aperture 500. Tab 122 is secured to the middle of upright interlocking member 68's bottom horizontal edge 427. Upright interlocking member 68 has an outer face 80, a first vertical edge 420, and a second vertical edge 425.

Arm 87 is connected to outer face 80 of upright interlocking member 68. Arm 87 is an elbow-shaped formation of two rectangular planar portions, a vertical rectangular planar portion 88, and a horizontal rectangular planar portion 90, disposed at a right angle to each other and normally to outer face 80. Vertical planar portion 88 is closer to upright interlocking member 68's first vertical edge 420 than to upright interlocking member 68's second vertical edge 425. Vertical planar portion 88 is positioned at a distance from upright interlocking member 68's first vertical edge 420 approximately equal to the thickness of depth extension member 92's vertical plate portion 94. Vertical planar portion 88 has a first vertical edge 405 and a second vertical edge 410. First vertical edge 405 is connected to outer face 80.

Horizontal planar portion 90 has a first horizontal edge 415 positioned below the top horizontal edge of upright interlocking member 68 by an amount approximately equal to the thickness of depth extension member 92's horizontal plate portion 96. Horizontal planar portion 90 has a second horizontal edge 243, the short edge farthest from upright interlocking member 68. Horizontal planar portion 90 also has a top face 545. Along the longitudinal axis of horizontal planar portion 90, there is an aligned series of holes 120 starting near the middle of horizontal planar portion 90 and ending near second horizontal edge 243. (There are five holes 120 in the series displayed in this preferred embodiment, but there could be a greater number of holes positioned closer together or a fewer number of holes positioned farther apart.)

Arm 87 slidably receives depth extension member 92. An inwardly-turned horizontal guide flange 98 extends along depth extension member 92's first outer edge 400, located on horizontal plate portion 96, and extends in a direction normal to the plane of outer face 80. An inwardly-turned horizontal guide flange 100 extends along depth extension member 92's second outer edge 395, located on vertical plate portion 94, and extends in a direction normal to the plane of outer face 80. The spacing of each flange 98 and 100 is approximately the same as the thickness of arm 87's planar portions 88 and 90, and such spacing forms horizontal guideways 102 and 104. Horizontal guideway 102 slidably receives arm 87's top edge 242, and horizontal guideway 104 slidably receives arm 87's bottom edge 241. Depth extender member 92's horizontal plate portion 96 has a bottom face 550. A thin rectangular tab 124, having an aperture 495, is secured to the middle of horizontal plate portion 96's edge that is parallel to and farthest from outer face 80. Aperture 495 is in alignment with series of holes 120.

Upright member 67 and vertical extension assembly 86 are illustrated from a downward and exploded perspective in FIG. 6. These parts allow the position of roller rod 44 (shown in FIG. 1) to be moved upward. Upright member 67 slidably receives upright interlocking member 68 of vertical extension assembly 86. Upright interlocking member 68 has outer face 80 which has a width approximately equal to the width of upright member 67, and an inner face 78 which has a slightly smaller width. Upright member 67 has two inwardly-turned guide flanges, 70 and 72. Guide flange 70 is located on first vertical edge 430, and guide flange 72 is located on second vertical edge 435. The spacing of each guide flange 70 and 72 is approximately the same as the thickness of inner face 78 of upright interlocking member 68, and such spacing forms guide flange 70's guideway 74 and guide flange 72's guideway 76. Inner face 78 has a width approximately equal to the distance from guideway 74 to guideway 76. Guideway 74 and guideway 76 slidably receive inner face 78 which then bears against rear face 437 of upright member 67.

Upright interlocking member 68 interlocks with upright member 67. On one side of upright interlocking member 68, a guideway 82 extends between inner face 78 and outer face 80 and slidably receives guide flange 70. On the other side of upright interlocking member 68, a guideway 84 extends between inner face 78 and outer face 80 and slidably receives guide flange 72.

FIG. 7 shows first bracket assembly 40 without roller rod 44 and with an exploded view of the screws and nuts for securing the adjusted position of first bracket assembly 40. Series of holes 120, tab 124, aperture 495, screw 132, and nut 138 secure depth extender member 92 in an adjusted position in relation to arm 87. Series of holes 126, tab 122, aperture 500, screw 130, and nut 136 secure upright interlocking member 68 in an adjusted position in relation to upright member 67. Series of holes 116, tab 118, aperture 505, screw 128, and nut 134 secure lateral extension member 58 in an adjusted position in relation to transverse member 56. Each of screws 128, 130, and 132 passes through its associated aperture 505, 500, or 495, respectively, on tab 118, 122, or 124, respectively, and then through a hole in series of holes 116, 126, or 120, respectively, to be received by mated nut 134, 136, or 138, respectively. When nuts 134, 136, and 138 are tightened, nut 134 bears against transverse member 56's first surface 471, nut 136 bears against upright member 67's front face 438, and nut 138 bears against the bottom face of arm 87's horizontal planar portion 90.

FIG. 8 illustrates a foreshortened section view of roller rod 44. It has four portions: a first portion 140, a second portion 141, a third portion 142, and a fourth portion 144. In the preferred embodiment of the present invention, roller rod 44 is a telescoping roller 139 formed from two telescoping tubes, underlying roller rod 146 and overlaying roller rod 148, which overlap in third portion 142. The inside diameter of overlaying roller rod 148 is slightly greater than the outside diameter of underlying roller rod 146 so that the inner end of underlying roller rod 146 can be snugly slid, in telescoping fashion, into the inner end of overlaying roller rod 148. The greater portion of underlying roller rod 146 projects beyond overlaying roller rod 148. Conventional joint rotation parts (not illustrated) may be used to permit longitudinal telescoping movement and to resist relative rotative movement between overlaying roller rod 148 and underlying roller rod 146. For example, overlaying roller rod 148 may have a longitudinal tongue, projection or indentation which is slidably disposed within a longitudinal groove on underlying roller rod 146.

First portion 140 has a conventional winding motor assembly 150 for opening and closing closure 38 (shown in FIG. 1) on roller rod 44. Conventional winding motor assembly 150 has a construction often employed in spring rollers and has the usual means for holding a winding spring wound up in the typical manner. Conventional winding motor assembly 150 is secured within underlying roller rod 146 at roller rod end 477. Since the construction and operation of winding motor assembly 150 is conventional, it is not described.

Conventional winding motor assembly 150 provides a bearing and support for a conductive shaft 385. An exterior end 390 of conductive shaft 385 extends outwardly from conventional winding motor assembly 150. Exterior end 390 and intermediate member 50 are joined as elements of a composite structure. Other ways of attaching exterior end 390 to intermediate member 50 may be substituted for the one just described. For example, a pin or dowel could be used to attach the two elements, or exterior end 390 could have flanges which could be secured to intermediate member 50.

Conductive shaft 385 is a composite structure of a primary shaft assembly 387 and a secondary shaft 388 joined at a conductive shaft extension assembly 163. In the preferred embodiment of the present invention, primary shaft assembly 387 includes a pintle 152 and a spring guide shaft 156 connected by a conventional link 350. The portion of pintle 152 which extends from roller rod 44 constitutes conductive shaft 385's exterior end 390. In roller rod 44's first portion 140, primary shaft assembly 387 extends from conventional winding motor assembly 150, then axially through second portion 141, and terminates in third portion 142 where it engages extension assembly 163, located beyond the enclosure of underlying roller rod 146. Secondary shaft 388 extends from extension assembly 163 in a direction away from conventional winding motor assembly 150 and terminates inside roller rod 44's fourth portion 144 where it contacts an expansive pressure assembly 310. The portion of secondary shaft 388 farthest from extension assembly 163 constitutes conductive shaft 385's interior end 162.

FIG. 9 is an enlarged section view of conductive shaft extension assembly 163 which permits the adjustment and maintenance of the length of telescoping roller 139 (shown in FIG. 8). Conductive shaft extension assembly 163 interconnects an engaged portion 236 of secondary shaft 388 with an engaged portion 355 of primary shaft assembly 387.

A base 360 is at the end of secondary shaft engaged portion 236. Base 360 has an opening 370 into a cavity 223 within secondary shaft engaged portion 236. Cavity portion 223 has an unthreaded portion 224 extending from cavity opening 370 to the beginning of a threaded cavity portion 230. Threaded cavity portion 230 extends to a closed base 232 of cavity 223. The length of threaded cavity portion 230 is approximately equal to the greatest possible change in the length of telescoping roller 139.

Primary shaft engaged portion 355 extends into cavity 223. Primary shaft engaged portion 355 has a threaded end 228 with threads 365. Threaded end 228 passes through unthreaded cavity portion 224 and twists into threaded cavity portion 230. The length of threaded end 228 is shorter than the length of unthreaded cavity portion 224. Primary shaft securing screws 222 (two are illustrated but more or less may be used) twist through secondary shaft engaged portion 236, at a minimal distance from cavity opening 370, pass into unthreaded cavity portion 224, and contact primary shaft engaged portion 355. Elongated handles 234 (two are illustrated but more or less may be used) extend normally from secondary shaft engaged portion 236.

FIG. 10 is a section view of roller rod 44's fourth portion 144 with expansive pressure assembly 310 which includes a housing 174 containing parts for exerting expansive pressure on bracket assemblies 40 and 42 (shown in FIG. 2).

Conductive shaft interior end 162 passes through a centered circular aperture 380 in a guide disk 375. The diameter of guide disk aperture 380 is slightly greater than the diameter of conductive shaft interior end 162. Guide disk 375 has a flanged rim 382 for securing guide disk 375 to the interior of roller rod 44. A weld or an adhesive may be applied between roller rod 44 and flanged rim 382.

Conductive shaft interior end 162 has a housing bearing 175 in the form of a rounded point. Housing bearing 175 is received by a hemispherical recess 173 on an end surface 172 of housing 174. The opening of hemispherical recess 173 is at least as wide as disk aperture 380. Housing bearing 175 may be made of a material with a low coefficient of friction, or a ball bearing 565 may be secured to the end of housing bearing 175.

Housing 174, which may be made of plastic, wood, tin or some other suitable material, has a cylindrical shape which snugly fits into roller rod 44 at closure assembly second end 300. Cap 178 closes the end of housing 174 facing outward from roller rod 44. Cap 178 is secured to housing 174 by screws 180. Other removable forms of attachment may be substituted for screws 180.

A hollow forward shaft 182 extends normally from intermediate member 50C's surface 51 which faces roller rod 44. Next, forward shaft 182 passes through a circular aperture 184 in cap 178. Aperture 184 has a diameter slightly greater than that of forward shaft 182. Then, forward shaft 182 enters a cylindrical housing cavity 186 in housing 174. Housing cavity 186 may be covered with a lining 570 made from a material with a low coefficient of friction.

Forward shaft 182's exterior end 181 and intermediate member 50C are joined as elements of a composite structure. Other ways of attaching exterior end 181 to intermediate member 50C may be substituted for the one just described. For example, a pin or dowel could be used to attach the two elements, or exterior end 181 could have flanges which could be secured to intermediate member 50C.

Forward shaft 182 has an axial bearing assembly 325 between it and housing 174. In the preferred embodiment of the present invention, forward shaft axial bearing assembly 325 includes grooves 190 and 192, snap rings 194 and 196, and a roller bearing 198. Grooves 190 and 192 are located on forward shaft 182 within housing cavity 186. Grooves 190 and 192 are spaced apart to receive snap rings 194 and 196, respectively. Relative to groove 190 and snap ring 194, groove 192 and snap ring 196 are farther inside housing cavity 186. Snap rings 194 and 196 form a cage for roller bearing 198 on forward shaft 182. The diameter of roller bearing 198 is slightly less than the diameter of housing cavity 186.

There are exterior threads 200 on forward shaft 182 farther inside housing cavity 186 than groove 192. Threads 200 receive a spring stop 202 and a locking element 203 for spring stop 202. Spring stop 202 is farther inside housing cavity 186 than locking element 203. Spring stop 202 may be a nut, and locking element 203 may be a locknut.

Forward shaft 182's has an open end 320 which terminates at approximately the longitudinal midpoint of housing cavity 186. Forward shaft 182's open end 320 receives an underlying portion 332 of a rearward shaft 204. The diameter of rearward shaft 204 is slightly less than the inner diameter of forward shaft 182, so that rearward shaft 204 can move easily along the axis of forward shaft 182, while its movement in other directions is restricted. A projecting portion 330 of rearward shaft 204 extends from forward shaft 182's open end 320. Projecting portion 330 terminates in a base bearing 206 which abuts housing cavity 186's closed base 315. Base bearing 206 is in the form of a rounded point. Base bearing 206 may be made of a material with a low coefficient of friction, or a ball bearing 560 may be secured to the end of base bearing 206.

Rearward shaft 204 has an axial bearing assembly 335 between it and housing 174. In the preferred embodiment of the present invention, rearward shaft axial bearing assembly 335 includes grooves 210 and 212, snap rings 214 and 216, and a roller bearing 218. On rearward shaft 204's projecting portion 330, there is a groove 212 farther inside housing cavity 186 than forward shaft open end 320. Groove 210 receives a snap ring 216. Rearward shaft 204 has a groove 210 farther inside housing cavity 186. Groove 210 receives a snap ring 214. Snap rings 214 and 216 form a cage for a roller bearing 218.

A spring 220 fits over portions of rearward shaft 204 and forward shaft 182 between rearward shaft axial bearing assembly 335 and forward shaft axial bearing assembly 325. One end of spring 220 abuts snap ring 216, and the other end abuts spring stop 202. Starting from rearward shaft 204's position relative to forward shaft 182 when spring 220 is not compressed, the distance that rearward shaft 204 can be pushed farther into forward shaft 182 is at least equal to the change in the length of spring 220 when it is fully compressed.

Figure 11:
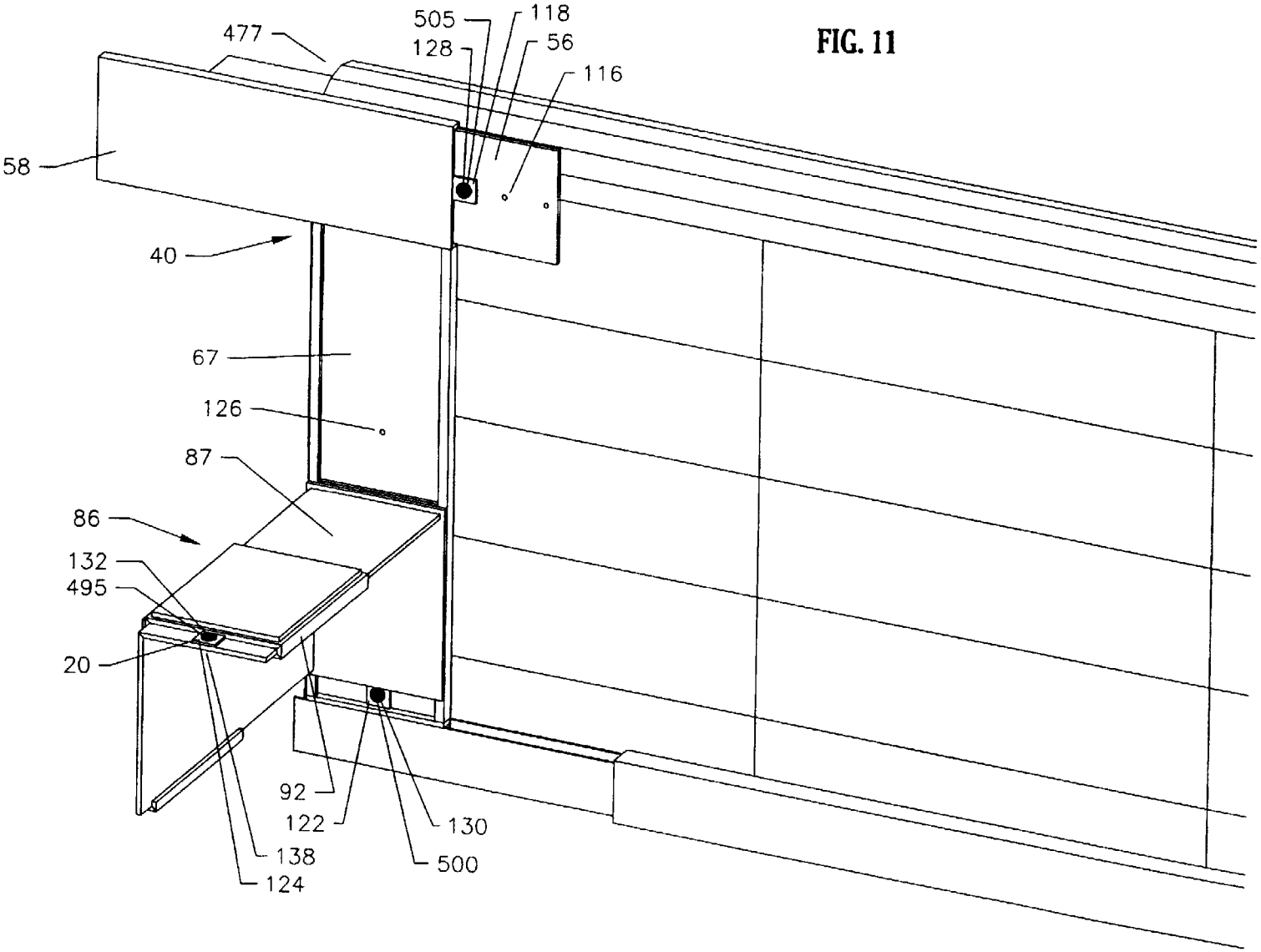
FIG. 11 is an isometric view of the back of one side of the present invention, with the illustrated bracket fully extended in all three dimensions.

FIG. 11 illustrates the back of first bracket assembly 40 fully extended in all three dimensions. Lateral extension member 58 is slid outward from transverse member 56 until tab 118's aperture 505 is in alignment with the hole, in series of holes 116, which is closest to roller rod end 477. Then lateral extension member 58 is secured to transverse member 56 by screw 128 and nut 134 (shown in FIG. 7). Vertical extension assembly 86 is slid downward on upright member 67 until tab 122's aperture 500 is in alignment with the lowermost hole in series of holes 126. Then vertical extension assembly 86 is secured to upright 67 by screw 130 and nut 136 (shown in FIG. 7). Depth extension member 92 is slid outward on arm 87 until tab 124's aperture 495 is in alignment with the most distal hole in series of holes 120. Then depth extension member 92 is secured to arm 87 by screw 132 and nut 138.

DETAILED OPERATIONAL DESCRIPTION OF THE INVENTION

Mounted Position on the Frame

Closure assembly 30 is manually mounted by the user. (To facilitate the description of the mounting process, the corner of frame 34 formed by stile 32*a* and the horizontal connecting member of frame 34 will be referred to as corner 33*a*. The corner of frame 34 formed by stile 32*b* and the horizontal connecting member of frame 34 will be referred to as corner 33*b*). Closure assembly 30 is installed by easing depth extension member 92 of first bracket assembly 40 into corner 33*b* of frame 34 so that closure assembly second end 300 extends diagonally downward. Next, the user presses second bracket assembly 42 inward, thereby compressing spring 220, raises closure assembly second end 300 parallel to frame 34's horizontal connecting member, and inserts second bracket assembly 42 into corner 33*a* of frame 34. Then second bracket assembly 42 is released, permitting the restorative force of spring 220 to press bracket assemblies 40 and 42 outward against stiles 32*b* and 32*a* to hold closure assembly 30 in a fixed position. Alternatively, a user could first position second bracket assembly 42 in corner 33*a*, and then ease first bracket assembly 40 into corner 33*b*.

When the preferred embodiment of the present invention is mounted, the location of certain of its parts makes it useful for closely covering an entire frame. Lateral extension member 58 abuts wall 36. The distance between closure 38 and the plane of wall 36 is minimal; it is approximately equal to the thickness of lateral extension member 58 plus the minimal clearance between closure 38 and lateral extension member 58.

When closure 38 is unwound, its width overlaps the width of the front of frame 34. Roller rod 44 and closure 38 are both wider than frame 34. Also, all of the components of closure assembly 30, except for each side's vertical extension assembly 86 and depth extension member 92, are positioned in front of the plane of wall 36, so closure 38 is also in front of the plane of wall 36.

When closure 38 is unwound, its length covers frame 34 from top to bottom. When vertical extension assembly 86 is in its uppermost adjusted position relative to upright member 67, roller rod 44 and the bottom of lateral extension member 58 are located just above the edge of the horizontal connecting member of frame 34. When vertical extension assembly 86 is adjusted to a different position, the positions of lateral extension member 58 and roller rod 44 will be even higher.

Winding and Unwinding the Closure

A user of the preferred embodiment of the present invention may "close" frame 34 by unwinding closure 38 from roller rod 44 to which it is attached. Frame 34 may be "opened" by winding closure 38 back onto roller rod 44. Alternatively, instead of winding closure 38 onto roller rod 44, a user may pass through frame 34 by merely pushing aside compliant closure 38.

Conventional winding motor assembly 150 allows closure 38 to be lowered or raised to a desired position, and then to remain in that position. Spring guide shaft 156 extends from conventional winding motor assembly 150 and supports a conventional winding spring. As closure 38 is lowered and roller rod 44 rotates, the winding spring is wound, and the pawl and ratchet of conventional winding motor assembly 150 is engaged to prevent the biasing force of the winding spring from restoring roller rod 44 to its original position. Upon disengagement of the pawl and ratchet of conventional winding motor assembly 150, the biasing force of the winding spring causes roller rod 44 to rotate so that closure 38 may be raised to a desired position, whereupon the pawl and ratchet engages to secure closure 38 in such position.

Resilient Frictional Support

In mounting closure assembly 44, compression of spring 220 inside expansive pressure assembly 310 causes outward pressure to be exerted directly on intermediate members 50 and 50C and indirectly on the other connected parts of bracket assemblies 40 and 42. Such outward force upon vertical plate portions 94 and 94C of depth extender members 92 and 92C, respectively, causes them to press against stiles 32*b* and 32*a* so hard that the resultant friction prevents movement of bracket assemblies 40 and 42 relative to frame 34.

Expansive pressure assembly 310 facilitates compression of spring 220. When intermediate member 50C is pressed inward, forward shaft 182 is pressed further into housing cavity 186. As forward shaft 182 moves inward, so does spring stop 202, which is held in place on forward shaft 182 by threads 200 and locking element 203. Spring stop 202 presses spring 220 inward. Spring 220 is compressed because the inward movement of spring 220 is stopped by snap ring 216, which is secured to rearward shaft 204 in groove 212. Rearward shaft 204 and its attached snap ring 216 do not translate inward because base bearing 206 of rearward shaft 204 abuts housing cavity base 315.

Forward shaft 182 and rearward shaft 204 are supported by each other and by roller bearings 198 and 218. Roller bearing 198 supports forward shaft 182 in alignment with the axis of housing cavity 186. Roller bearing 198 is encaged by snap rings 194 and 196, which are secured in position by grooves 190 and 192 on forward shaft 182. Roller bearing 218 supports rearward shaft 204 in alignment with the axis of housing cavity 186. Roller bearing 218 is encaged by snap rings 214 and 216, which are secured in position by grooves 210 and 212 on rearward shaft 204. Forward shaft 182 and rearward shaft 204 support each other in alignment with the axis of housing cavity 186 because forward shaft 182's open end 320 overlaps rearward shaft underlying portion 332.

The expansive pressure upon first bracket assembly 40 and second bracket assembly 42 secures them in fixed frictional engagement with frame 34. Compressed spring 220 exerts an outward force on second bracket assembly 42. Spring 220 exerts pressure against spring stop 202 which is transmitted to forward shaft 182, and thereby to intermediate member 50C. Thus, intermediate member 50C is subject to an outward force that is normal to stile 32*a*. This force is transmitted through second bracket assembly 42 to vertical plate portion 94C of depth extension member 92C, causing vertical plate portion 94C to press hard against stile 32*a*.

Compressed spring 220 also exerts an outward force on first bracket assembly 40. Spring 220 exerts pressure on snap ring 216, which is connected to rearward shaft 204. Rearward shaft 204 transmits the force to housing 174 and abutting conductive shaft interior end 162. The force is transmitted through conductive shaft 385 to conductive shaft exterior end 390 and then to intermediate member 50. Thus, intermediate member 50 is subject to an outward force that is normal to stile 32*b*. This force is transmitted through first bracket assembly 40 to vertical plate portion 94 of depth extension member 92, causing vertical plate portion 94 to press hard against stile 32*b*.

Static and Rotating Parts

Roller rod 44 rotates on attached bracket assemblies 40 and 42 during the raising and lowering of closure 38. However, some internal parts of roller rod 44 remain static. On closure assembly first end 305, intermediate member 50 is static and so is pintle 152 which is connected to intermediate member 50. Thus, spring guide shaft 156, which is attached to pintle 152, does not rotate. Since pintle 152 and spring guide shaft 156, components of primary shaft assembly 387, are static, so is secondary shaft 388 because primary shaft securing screws 222 are twisted through secondary shaft 388 into static frictional engagement with primary shaft assembly 387 before the present invention is mounted.

On closure assembly second end 300, intermediate member 50C is static and so is forward shaft 182 which is connected to intermediate member 50C. Since forward shaft 182 is static, so are the following parts attached to forward shaft 182: snap rings 194 and 196, spring stop 202, and locking element 203.

An underlying portion 332 of rearward shaft 204 is received by forward shaft open end 320. When the present invention is dismounted, rearward shaft 204 can rotate. Rearward shaft underlying portion 332 can rotate within forward shaft open end 320, and rearward shaft projecting portion 330 can rotate upon housing cavity base 315.

However, when the present invention is mounted, rearward shaft 204 does not rotate because there are large normal expansive forces exerted by spring 220 upon spring stop 202, which is static, and upon snap ring 216, which is connected to rearward shaft 204. The normal force between spring 220 and spring stop 202 causes friction which holds these two parts in fixed relation to each other. The normal force between spring 220 and snap ring 216 causes friction which holds these two parts in fixed relation to each other. Thus, spring 220, snap ring 216, and spring stop 202 are static. Rearward shaft 204 is static because it is connected to static snap ring 216. Snap ring 214 is static because it is connected to rearward shaft 204.

Housing 174 rotates as a unit with overlaying roller rod 148. Housing 174 rotates relative to forward shaft 182 and rearward shaft 204. Housing cavity base 315 rotates upon rearward shaft 204's base bearing 206. The sides of housing cavity 186 rotate upon roller bearings 198 and 218. Roller bearing 198 rotates around forward shaft 182, and roller bearing 198 is secured in longitudinal position on forward shaft 182 by snap rings 194 and 196. Roller bearing 218 rotates around rearward shaft 204, and roller bearing 218 is secured in longitudinal position on rearward shaft 204 by snap rings 214 and 216.

At the center of housing end surface 172, conductive shaft interior end 162's housing bearing 175 rotates in hemispherical recess 173. The reception of housing bearing 175 within hemispherical recess 173 also facilitates the horizontal alignment of the axes of roller rod 44 and conductive shaft 385.

When roller rod 44 rotates, conventional joint rotation parts cause underlying roller rod 146 and overlaying roller rod 148 to rotate as a unit. On closure assembly first end 305, underlying roller rod 146 rotates relative to conductive shaft 385 due to conventional winding motor assembly 150.

When closure assembly 30 is mounted, roller rod 44 can rotate smoothly even though expansive forces are exerted by spring 220 upon the internal parts of roller rod 44. Rearward shaft 204 is subject to an inward axial force caused by spring 220 and such force may retard rotation between rearward shaft 204's base bearing 206 and housing cavity base 315. It is important to facilitate the smooth rotation of the internal parts of housing 174. If lining 570 having a low coefficient of friction is used to cover housing cavity 186, then roller bearings 198 and 218 and base bearing 206 can rotate smoothly on housing cavity 186. Also, if base bearing 206 is made of a suitable material with a low coefficient of friction or ball bearing 560 is secured to the end of base bearing 206, rotation between base bearing 206 and housing cavity base 315 is facilitated.

The expansive force of spring 220, acting through rearward shaft 204, causes hemispherical recess 173 to press hard against housing bearing 175. The resultant friction may retard the rotation of housing bearing 175 within hemispherical recess 173. It is important to facilitate the smooth rotation of housing bearing 175 on hemispherical recess 173. If a lining (not shown) having a low coefficient of friction is used to cover hemispherical recess 173, then housing bearing 175 can rotate smoothly on hemispherical recess 173. Also, if housing bearing 175 is made of a suitable material with a low coefficient of friction or ball bearing 565 is secured to the end of housing bearing 175, rotation between housing bearing 175 and hemispherical recess 173 is facilitated.

Spring 220 exerts an expansive force that is transmitted by conductive shaft 385 through conventional winding motor assembly 150 to intermediate member 50. The rotating parts of conventional winding motor assembly 150 are not subject to the pressure exerted by spring 220, thus there is no need to add parts to conventional winding motor assembly 150 in order to compensate for the negative effects of such pressure.

Extension of Brackets

By simultaneously adjusting the lateral positions of lateral extension members 58 and 58C, the distance between arm 87 and arm 87C may be changed to fit the width of a particular frame 34. The position of lateral extension member 58 may be changed by sliding it further onto or off of transverse member 56. Thus, the lateral position of arm 87 may be adjusted because it is indirectly connected to lateral extension member 58. Likewise, the lateral position of arm 87C may be adjusted by changing the position of lateral extension member 58C.

The position of lateral extension member 58 is secured by (a) sliding lateral extension member 58, via its guideways 64 and 66, along transverse member 56 until it reaches a desired position in which lateral extension member 58's aperture 505 is in alignment with one of a series of holes 116 in transverse member 56, (b) inserting screw 128 through aperture 505 of tab 118 and through the aligned hole in series of holes 116, and (c) placing nut 134 on screw 128 and tightening nut 134 against first surface 471 of transverse member 56. Screw 128 and nut 134 prohibit sliding movement between lateral extension member 58 and transverse member 56. Other forms of securing lateral extension member 58 to transverse member 56 may be substituted for the nut-screw set just described. The position of lateral extension member 58C is secured in a similar manner.

Vertical extension assembly 86 and depth extension member 92 are needed when, as illustrated in FIG. 12, a rectangular wall periphery 520 formed by wall 36 around frame 34 is taller and in a different plane than a rectangular stile periphery 525 formed by stiles **32*a*, stile 32*b* and horizontal stile connecting member 530. Such a frame 237 (hereinafter, a "multi-plane frame") has a connecting surface 535 between stile periphery 525 and wall periphery 520. Connecting surface 535** is usually slanted or stepped.

Vertical extension assembly 86 and upright member 67 are used to raise roller rod 44 to a height where the bottom of roller rod 44 is higher than wall periphery top horizontal 540. Thereby, closure 38 can extend downward from roller rod 44 and cover the full height of wall periphery 520.

The vertical position of roller rod 44 relative to arm 87 is changed by adjusting the vertical position of upright member 67 relative to upright interlocking member 68 since roller rod 44 is indirectly connected to upright member 67, and arm 87 is connected to upright interlocking member 68.

Upright interlocking member 68 and upright member 67 slidably interconnect so that upright interlocking member 68 can slide up and down along upright member 67. Upright interlocking member 68's inner face 78 slides in guideway 74, formed by upright member 67's guide flange 70, and in guideway 76, formed by upright member 67's guide flange 72. At the same time, upright member 67's guide flange 70 slides in upright interlocking member 68's guideway 82, and upright member 67's guide flange 72 slides in upright interlocking member 68's guideway 84.

The position of vertical extension assembly 86 is secured by (a) sliding upright interlocking member 68 along upright member 67 until it reaches a desired position in which upright interlocking member 68's aperture 500 is in alignment with one of a series of holes 126 of upright member 67, (b) inserting screw 130 through tab 122's aperture 500 and through the aligned hole in series of holes 126, and (c) placing nut 136 on screw 130 and tightening nut 136 against upright member 67's front face 438. Screw 130 and nut 136 prohibit sliding movement between vertical extension assembly 86 and upright member 67. Other forms of securing vertical extension assembly 86 to upright member 67 may be substituted for the nut-screw set just described. The position of vertical extension assembly 86C is secured in a similar manner.

In a multi-plane frame 237, depth extension member 92 is used as a way to ensure that frame pad 106 has full contact with stile **32*b*. Full contact is needed to maximize the friction between stile 32*b* and frame pad 106, and thereby provide the best friction-based support for closure assembly 30. When the present invention is mounted on a multi-plane frame 237 with a roller rod 44 wider than wall periphery 520, upright member 67 and upright interlocking member 68 are parallel to and just in front of the plane of wall periphery 520, and arm 87 extends rearward from upright interlocking member 68, passing normally through the plane of wall periphery 520 and the plane of stile periphery 525. A problem is created when depth extension member 92 is positioned on arm 87 closest to upright interlocking member 68 because part or all of frame pad 106 on depth extension member 92's vertical plate portion 94 will not contact stile 32*b* due to the separation between stile periphery 525 and wall periphery 520**.

To solve this problem, depth extension member 92 can be slid back on arm 87 until all of frame pad 106 contacts stile **32*b*. Arm 87 and depth extension member 92 slidably interconnect. Top edge 242 of arm 87's horizontal planar portion 90 is slidably received by depth extension member 92's guideway 102. Bottom edge 241 of arm 87's vertical planar portion 88 is slidably received by depth extension member 92's guideway 104**.

The position of depth extension member 92 is secured by (a) sliding it along arm 87 until it reaches a desired position in which depth extension member 92's aperture 495 is in alignment with one of a series of holes 120 of arm 87, (b) inserting screw 132 through tab 124's aperture 495 and through the aligned hole in series of holes 120, and (c) placing nut 138 on screw 132 and tightening nut 138 against the bottom face of arm 87's horizontal planar portion 90. Screw 132 and nut 138 prohibit sliding movement between arm 87 and depth extension member 92. Other forms of securing depth extender member 92 to arm 87 may be substituted for the nut-screw set just described. The position of depth extender member 92C is secured in a similar manner.

Telescoping Roller

Telescoping roller 139 provides a way of adjusting the spacing between arms 87 and 87C so that the present invention can be mounted on a frame of a certain width. Telescoping roller 139 supplements the function of lateral extension members 58 and 58C which are used as a different way of extending the distance between arms 87 and 87C. Thus, by using telescoping roller 139 and lateral extension members 58 and 58C to increase the width between arms 87 and 87C, it is possible to achieve a separation between arms 87 and 87C that is greater than could be accomplished by using either telescoping roller 139 alone or lateral extension members 58 and 58C alone. Consequently, there is a greater range of possible door widths in which the present invention can be mounted.

Underlying roller rod 146 of telescoping roller 139 can slidably extend from overlaying roller rod 148. Conductive shaft 385 maintains the length of telescoping roller 139. Due to conductive shaft 385, it is not possible to inadvertently force underlying roller rod 146 completely into overlying roller cylinder 148, which would jam the structure and greatly damage or even destroy its practical value. As underlying roller rod 146 slides into overlaying roller rod 148, it stops when conductive shaft interior end 162 contacts housing 174.

In third portion 142 of telescoping roller 139, conductive shaft extension assembly 163 permits the extension of telescoping roller 139. Overlaying roller rod 148 can be slid completely away from underlying roller rod 146 and conductive shaft 385. Then, primary shaft securing screws 222 can be accessed and twisted outward until they are not in static frictional engagement with primary shaft engaged portion 355. Handles 234 may be used to manually turn secondary shaft 388. Primary shaft engaged portion 355 is static, but secondary shaft engaged portion 236's threaded cavity portion 230 can rotate upon primary shaft engaged portion 355's threaded end 228. As secondary shaft engaged portion 236 turns, it will translate towards or away from primary shaft engaged portion 355 depending on the direction of the rotation. To make conductive shaft 385 longer, secondary shaft engaged portion 236 can be twisted to translate outward from primary shaft engaged portion 355, and then primary shaft securing screws 222 can be tightened upon primary shaft engaged portion 355 to prevent primary shaft engaged portion 355 from rotating relative to secondary shaft engaged portion 236. Then, when the user slides overlaying roller rod 148 over conductive shaft 385 and underlying roller rod 146, overlaying roller rod 148 will stop when housing end surface 172 contacts conductive shaft 385, and the resulting position of overlaying roller cylinder 148 will make the overall length of telescoping roller 139 longer than it was before secondary shaft 388 was twisted outward from primary shaft assembly 387. In a similar manner, telescoping roller 139 may be shortened by twisting secondary shaft 388 inward towards primary shaft assembly 387.

Minor Parts And Functions

Although the functions of the major parts have been described above, it is also important to describe the purposes of several minor parts of the preferred embodiment of the present invention.

Cap 178 prevents the parts inside housing 174 from coming out of housing cavity 186 when the present invention is dismounted. Cap 178 is secured to housing 174 by screws 180. Forward shaft 182 passes through central cap aperture 184 of cap 178, and cap 178 serves as a stop for limiting the outward movement of snap ring 194, which is attached to forward shaft 182. Thus, cap 178 also functions as a stop for all of the other parts inside housing cavity 186.

Frame pad 108 is attached to vertical plate portion 94 of depth extension member 92 to provide better frictional engagement between first bracket assembly 40 and stile 32*b*. Frame pad 108 also prevents stile 32*b* from being marred by first bracket assembly 40. Frame pad 106 prevents the top connecting member between stiles 32*a* and 32*b* from being marred by first bracket assembly 40.

When closure 38 is rolled up onto roller rod 44, slat 48 functions as a part at the bottom of closure 38 which a user can easily grasp to pull closure 38 downward. When closure 38 is rolled down from roller rod 44, slat 48 also serves as a weight at the bottom of closure 38 to keep it taunt and to stop it from swaying in any wind.

Another purpose of slat 48, in conjunction with catch 110, is to stop the upward movement of closure 38 before its bottom edge passes the bottom of bracket assemblies 40 and 42. By not allowing closure 38 to roll all of the way up to roller rod 44, it is easier for a user to grasp slat 48 because slat 48 is not as high. Moreover, if slat 48 rolled all of the way up to the bottom of roller rod 44, there would be little, if any, clearance for a user's fingers to grab slat 48. Furthermore, by stopping the upward movement of closure 38 before its bottom edge passes the bottom of bracket assemblies 40 and 42, almost all portions of bracket assemblies 40 and 42 will not be visible from the front because they will be hidden by closure 38. This is more aesthetically appealing than allowing bracket assemblies 40 and 42 to be exposed.

The upward movement of closure 38 is stopped when slat 48, at the bottom of closure 38, engages catches 110 and 110C at the bottom of bracket assemblies 40 and 42, respectively. Slat 48 is supported within slat pocket 46 at the bottom of closure 38. A portion of slat 48 is exposed on both sides of slat pocket 46. As closure 38 winds up on roller rod 44, it may be stopped by guiding the exposed portions of slat cavity 117, on both sides of slat 48, over vertical portions 111 and 111C of catches 110 and 110C, respectively. Then, portions 113, 114, and 115 of slat 48 encage vertical portions 111 and 111C of catches 110 and 110C, respectively, and thereby restrict the forward, backward and upward movement of slat 48 and closure 38.

The purpose of palm pad 54 is to facilitate manual compression of closure assembly 30 during mounting. Compression of closure assembly 30 may be effected by using the palms to press inward simultaneously on palm pads 54 and 54C of intermediate members 50 and 50C, respectively. Palm pads 54 and 54C provide a cushion for the user's palms.

When intermediate member 50C is pressed inward to compress spring 220, the degree of compression may not be enough to create sufficient expansive forces on bracket assemblies 40 and 42 to hold them in fixed frictional engagement with frame 34. Spring stop 202 may be adjusted to increase the amount of compression. In order to access spring stop 202, a user detaches cap 178 by removing screws 180 holding cap 178 to housing 174. Then forward shaft 182, along with roller bearing 198, snap rings 194 and 196, spring stop 202 and locking element 203, are withdrawn from housing cavity 186. Spring stop 202, which serves as a stop for one end of spring 220, is twisted to cause it to move inward to a desired position on threads 200 of forward shaft 182. Then locking element 203 is tightened upon spring stop 202 in order to prevent the outward movement of spring stop 202 when the present invention is mounted. Finally, the parts removed from housing cavity 186 are replaced.

The purpose of guide disk 375 is to provide support for conductive shaft interior end 162 when closure assembly 30 is not mounted. In that case, conductive shaft interior end 162's housing bearing 175 may slip out of hemispherical recess 173 because there is no expansive force exerted by spring 220 to hold housing bearing 175 in place. Thus, due to this loss of support for conductive shaft interior end 162, it may sag downward. However, since conductive shaft interior end 162 passes through guide disk aperture 380, any sagging of conductive shaft interior end 162 will stop as soon as it contacts guide disk 375. Then, during mounting, conductive shaft interior end 162 can be easily guided back into hemispherical recess 173 because guide disk 375 keeps conductive shaft interior end 162's housing bearing 175 from sagging beneath the opening of hemispherical recess 173, which is at least as wide as disk aperture 380. When closure assembly 30 is mounted, there is no contact between guide disk 375 and conductive shaft interior end 162. The center of guide disk aperture 380 coincides with the axis of conductive shaft 385, and the diameter of guide disk aperture 380 is slightly greater than the diameter of conductive shaft interior end 162.

Other Embodiments

The front of another embodiment of the present invention is illustrated from a perspective view in FIG. 13. A closure 575 hangs from a rod 580 of closure assembly 30. Closure 575 is partially open. Closure 575 can be opened or closed by moving it horizontally across frame 34. Rod 580 may be telescopic.

FIG. 14, an enlarged isometric view, illustrates another way of facilitating depth extension, although it may also be used for vertical extension. There is an aligned series of recesses 238 extending along the longitudinal axis of top face 545 of arm 87's horizontal planar portion 90. Recesses 238 start at approximately the middle of horizontal planar portion 90 and end at second horizontal edge 243. There is a resilient lug 240 on bottom face 550 of depth extender member 92's horizontal plate portion 96. Resilient lug 240 is in alignment with series of recesses 238. Each recess 238 is just large enough for resilient lug 240 to fit snugly therein. As depth extension member 92 is adjusted to a desired position by sliding it over arm 87, lug 240 undergoes compression and expansion as it passes over recesses 238. When the desired position is reached and lug 240 is lodged in one of recesses 238, depth extension member 92 is securely held in its position because it takes a significant force to dislodge lug 240. In comparison to the preferred embodiment, the significant difference of this embodiment is that it requires fewer parts. It does not need a nut, screw and apertured tab like the preferred embodiment described above.

FIG. 15, an enlarged isometric view, illustrates another way of facilitating depth extension, although it may also be used for vertical extension. There is a slot 256 extending along the longitudinal axis of arm 87's horizontal planar portion 90. Slot 256 starts at approximately the middle of horizontal planar portion 90 and opens outward at second horizontal edge 243. There is a screw 510 on bottom face 550 of depth extender member 92's horizontal plate portion 96. Screw 510 is in alignment with slot 256, which is slightly wider than screw 510. As depth extension member 92 is adjusted to a desired position by sliding it over arm 87, screw 510 passes through slot 256, which serves as a guide for screw 510. When the desired position is reached, a nut 515 is twisted onto screw 510 to secure depth extender member 92 in position relative to arm 87. The distinguishing feature of the embodiment illustrated in FIG. 15 is that slot 256 and screw 510 provide a continuous range of adjustment between depth extension member 92 and arm 87.

FIG. 16, an enlarged elevation view, illustrates a catch 258 which may replace catch 110 (shown in FIG. 3). Catch 258 is in the form of a prism with right triangle faces 485 and a slanted surface 260. Catch 258 has a base 555 which is the planar surface connecting the shortest sides 490 of each right triangle face 485. Base 555 has the same length and width as the bottom of upright member 67, and base 555 is connected to the bottom of upright member 67 such that slanted surface 260 of catch 258 faces away from closure 38.

Since the shape of catch 258 is different, a differently shaped slat 262 may replace slat 48 (shown in FIG. 3). Slat 262 is an angular formation of three planar surfaces. There is a planar portion 264 parallel and adjacent to closure 38. Planar portion 264 is attached to and perpendicular to a bottom planar portion 266. A slanted planar portion 268 extends from bottom planar portion 266 at an obtuse angle.

The purpose of catch 258 and slat 262 is the same as that of catch 110 and slat 48. It is easy for a user to guide the opening of slat 262 over the bottom of catch 258 because the opening of slat 262 is wide and the bottom of catch 258 narrows to a point.

The present invention may be used for certain purposes in window frames. For example, the present invention could be used as a rollaway shade closure easily installed in a window between the inside of a concession stand and the outside area. The present invention could be mounted with the closure on the inside, so when it closes it will cover the entire window frame and customers will not be able to see inside.

Closure 38 may be made more aesthetically appealing by imprinting designs on it. The present invention may be mounted in a frame between the interior of a building and its exterior so such imprinted designs would be visible by those on the outside.

Summary and Scope

To summarize, my present invention is an instant screen door having a roller or rod with an internal assembly that pressures attached non-marring brackets into static frictional engagement with the stiles of a door frame so the present invention can be quickly mounted without marring the frame and easily removed for storage or for transfer. The present invention has brackets that are extensible in three dimensions for mounting on frames of various types and widths. The brackets position the roller or rod at a minimal distance from the wall, outside the frame, and at the top or above the frame, so that an attached closure can cover the frame completely and closely, thus making it useful for barring insects, light or visibility.

While the present invention has been particularly illustrated and described in terms of specific embodiments, it should be understood that the foregoing illustrations, descriptions and embodiments are intended to be exemplary and not definitive, and that the present invention is susceptible of varied embodiments and to some change and modification in detail, particularly by those skilled in the art, without departing from the scope, principles and spirit of the present invention or sacrificing any of its advantages. For this reason, I do not wish to be understood as limiting myself to the precise embodiments, arrangements and formations of the several parts herein shown and described in carrying out the present invention in practice; rather, the present invention is to be broadly construed and limited only by the scope and spirit of the claims now appended hereto. Accordingly, all such changed embodiments or variations in detail that utilize the concepts of the invention and incorporate the spirit thereof are to be considered as within the scope of the claims appended below, unless these claims by their language specifically state otherwise.

I claim:

1. A closure assembly for mounting on a frame in a wall, said frame having a horizontal dimension and being formed of a pair of stiles connected by a horizontal connecting member, said closure assembly comprising in combination:

(a) a roller rod having a first end and a second end, said roller rod being longer than said horizontal dimension of said frame, said roller rod including two telescopingly engaged hollow cylindrical portions, (b) a closure coupled to said roller rod, (c) first and second bracket means for positioning said roller rod minimally close to said wall, outside said frame, and at or above the top of said frame, each of said bracket means being extensible in three dimensions, and each of said bracket means including:

a depth extender member comprising a vertical plate portion for contacting one of said stiles of said frame, a horizontal portion for contacting said horizontal connecting member of said frame, a first extender outer edge normal to said frame and positioned on said horizontal plate portion, a first extender flange extending from said first extender outer edge, a second extender outer edge normal to said frame and positioned on said vertical plate portion, a second extender flange extending from said second extender outer edge, a first extender guideway formed between said first extender flange and said first extender outer edge and a second extender guideway formed between said second extender flange and said second extender outer edge, a right angle shaped arm comprising:

a vertical planar portion normal to said frame, said vertical planar portion having a first arm vertical edge adjacent said frame and a second arm vertical edge farther from said frame then said first arm vertical edge, and a horizontal planar portion, said horizontal planar portion having a first arm horizontal edge, normal to said stiles and adjacent to said frame, and a second arm horizontal edge normal to said stiles;

said arm being substantially longer than said depth extender member, and said arm being slidably received by said first extender guideway and said second extender guideway, depth extender securing means for holding said depth extender member in an adjusted position in relation to said arm, an upright interlocking member parallel to said frame, said upright interlocking member being connected to said first arm vertical edge and to said first arm horizontal edge, said upright interlocking member having a first upright interlocking vertical edge and a second upright interlocking vertical edge parallel to said stiles, and having a first upright interlocking guideway along said first interlocking upright interlocking vertical edge and a second upright interlocking guideway along said second upright interlocking vertical edge, an upright member parallel to said frame, said upright member being substantially longer than said upright interlocking member, said upright member having a top upright horizontal edge, a first upright vertical edge and a second upright vertical edge, a first lateral upright flange extending from said first upright vertical edge and a second upright lateral flange extending from said second upright vertical edge, a first upright guideway formed between said first upright lateral flange and a second upright guideway formed between said upright second lateral flange, said first upright guideway and said second upright guideway being slidably interengaged with said first upright interlocking guideway and said second upright interlocking guideway, an upright interlocking member securing means for holding said upright interlocking member in an adjusted position in relation to said upright member, a lateral extension member positioned parallel to said frame including:

a lateral extension vertical edge in alignment with one of said upright vertical edges, top and bottom lateral extension longitudinal edges, a portion of said bottom lateral extension longitudinal edge being connected to said top upright horizontal edge, a lateral extension longitudinal flange positioned along each of said top and bottom lateral extension longitudinal edges, said lateral extension longitudinal flanges extending in a direction opposite to the direction in which said first upright lateral flange and said second upright lateral flange extends, and lateral extension horizontal guideways formed by each of said lateral extension longitudinal flanges, a transverse member oriented parallel to said frame, said transverse member having a planar, rectangular first surface and a planar, rectangular second surface facing in opposite directions, said second surface facing the direction in which said arm extends from said upright interlocking member, said transverse member being slidably received in said lateral extension horizontal guideways, lateral extension member securing means for holding said lateral extension member in an adjusted position in relation to said transverse member, an intermediate member extending normally from said second surface of said transverse member, said intermediate member being positioned at an end of said second surface of said transverse member farthest from said upright member, and frame pads formed of a material having a high coefficient of friction, secured to said vertical planar portion of said depth extender member and to said horizontal planar portion of depth extender member, (d) a slat pocket positioned at the bottom of said closure between said first bracket means and said second bracket means, (e) slat means having a length approximately equal to that of said closure and comprising a right angled association of three planar surfaces forming a slat cavity having an upward opening and extending longitudinally across said slat means, said slat means being slidably received within said slat pocket, (f) a catch extending downward from the bottom of said upright member, said catch being thinner than said cavity of said slat means, (g) a housing located within said second end of said roller rod, said housing including an end surface facing towards said first end of said roller rod and including a housing cavity having a closed base, sides and opening away from said first end of said roller rod, (h) expansive pressure means for forcing said first and second bracket means outwardly into static frictional engagement with said stiles of said frame, said expansive pressure means being located substantially within said housing, and said expensive pressure means including:

a forward shaft having an interior end within said housing cavity and having an exterior end protruding from said housing cavity and coupled to said second bracket means, forward shaft axial bearing means for maintaining said forward shaft within said housing cavity in axial alignment with said roller rod, and for permitting relative movement between said sides of said housing cavity and said forward shaft, a rearward shaft slidably associated with said interior end of said forward shaft and extending towards said base of said housing cavity, base bearing means for facilitating rotation between said rearward shaft and said base of said housing cavity, rearward shaft axial bearing means for maintaining said rearward shaft within said housing cavity in axial alignment with said roller rod, and for permitting relative movement between the sides of said ho using cavity and said rearward shaft, spring means positioned between said forward shaft axial bearing means and said rearward shaft axial bearing means, spring stop means bearing against said spring means, said spring stop means being positioned between said forward shaft axial bearing means and said rearward shaft axial bearing means, and locking means for fixing the position of said spring stop means relative to said housing when said closure assembly is mounted in said frame, said locking means being removable to permit translation of said spring stop means relative to said housing, (i) conductive shaft means for conducting the force of said expansive pressure means, said conductive shaft means having an external end coupled to said first bracket means, said conductive shaft means having an internal end located within said roller rod, said conductive said conductive shaft means having primary shaft engaged with a secondary shaft, said primary shaft extends towards said first end of said roller rod, said secondary shaft extends towards said second end of said roller rod, said primary shaft has a primary engaged portion at one end of said primary shaft farthest from said first end of said roller rod, said secondary shaft has a secondary engaged portion at an end of said secondary shaft farthest from said second end of said roller rod, said secondary engaged portion has a base perpendicular to a longitudinal axis of said roller rod, said primary shaft has threads on the exterior of the end of said primary engaged portion forming a threaded end, said threaded end of said primary shaft is located beyond the boundary of said telescoping portion of said roller rod, said secondary shaft has a secondary shaft cavity with an opening at said base of said secondary engaged portion, said secondary shaft cavity of said secondary shaft has a closed base within said secondary shaft engaged portion, said secondary shaft cavity has a threaded cavity portion and an unthreaded cavity portion, said unthreaded cavity portion extending from said opening of said secondary shaft cavity to said threaded cavity portion of said secondary shaft cavity, said unthreaded cavity portion being longer than said threaded end of said primary shaft, said threaded cavity portion of said secondary shaft extends to said closed base of said secondary shaft cavity, the length of said threaded cavity portion being approximately equal to the maximum change in length of said roller rod, said threaded end of said primary shaft passes through unthreaded cavity portion of said secondary shaft and twists into said threaded cavity portion of said secondary shaft, and conductive shaft extension means for adjustably extending and maintaining the length of said conductive shaft means, said conductive shaft extension means includes primary shaft securing means for holding said primary shaft in an adjusted position in relation to said secondary shaft, said primary shaft securing means having a screw that twists through said secondary engaged portion, through said unthreaded cavity portion and contacts said primary shaft, (j) housing bearing means for facilitating rotation between said internal end of said conductive shaft means and said end surface of said housing, and (k) winding means for winding and unwinding said closure on said roller rod, whereby said closure assembly may be quickly mounted for covering said frame completely and closely to minimize the passage of insects, light or visibility through said frame.

2. A closure assembly for mounting on a frame in a wall said frame having a horizontal dimension and being formed of a pair of stiles connected by a horizontal connecting member, said closure assembly comprising in combination:

a hollow roller rod having a first end and a second end, said roller rod being longer than the horizontal dimension of said frame, a closure coupled to said rod, first and second bracket means for positioning said roller rod minimally close to said wall, outside said frame, and at or above the top of said frame, said first and second bracket means including plate means for contacting said stiles of said frame, a housing located within said second end of said roller rod, said housing having an end surface facing towards said first end of said roller rod, an expansive pressure means for forcing said first and second bracket means outwardly into static frictional engagement with the stiles of said frame, said expansive pressure means being located substantially within said housing and said expansive pressure means being coupled to said second bracket means, conductive shaft means for conducting the force of said expansive pressure means, said conductive shaft means having an external end coupled to said first bracket means, and said conductive shaft means having an internal end located within said roller rod near said end surface of said housing;

bearing means for facilitating rotation between said conductive shaft internal end of said conductive shaft and said end surface of said housing, and winding means for winding and unwinding said closure on said roller rod, whereby said closure assembly may be quickly mounted for covering said frame completely and closely to minimize the passage of insects, light or visibility through said frame.

3. The closure assembly of claim 2 wherein said roller rod includes two telescopingly engaged hollow cylindrical portions, and conductive shaft extension means for adjustably extending and maintaining the length of said conductive shaft means.

4. The closure assembly of claim 3 wherein said conductive shaft means includes a primary shaft engaged with a secondary shaft, said primary shaft extends towards said first end of said roller rod, said secondary shaft extends towards said second end of said roller rod, said primary shaft has a primary engaged portion at one end of said primary shaft farthest from said first end of said roller rod, said secondary shaft has a secondary engaged portion at an end of said secondary shaft farthest from said second end of said roller rod, said secondary engaged portion has a base perpendicular to a longitudinal axis of said roller rod, said primary shaft has threads on the exterior of the end of said primary engaged portion forming a threaded end, said threaded end of said primary shaft is located beyond the boundary of said telescoping portion of said roller rod, said secondary shaft has a secondary shaft cavity with an opening at said base of said secondary engaged portion, said secondary shaft cavity of said secondary shaft has a closed base within said secondary shaft engaged portion, said secondary shaft cavity has a threaded cavity portion and an unthreaded cavity portion, said unthreaded cavity portion extending from said opening of said secondary shaft cavity to said threaded cavity portion of said secondary shaft cavity, said unthreaded cavity portion being longer than said threaded end of said primary shaft, said threaded cavity portion of said secondary shaft extends to said closed base of said secondary shaft cavity, the length of said threaded cavity portion being approximately equal to the maximum change in length of said roller rod, said threaded end of said primary shaft passes through unthreaded cavity portion of said secondary shaft and twists into said threaded cavity portion of said secondary shaft, and further comprising a conductive shaft extension means for adjustably extending and maintaining the length of said conductive shaft means which includes primary shaft securing means for holding said primary shaft in an adjusted position in relation to said secondary shaft.

5. The closure assembly of claim 4 wherein said primary shaft securing means includes a screw that twists through said secondary engaged portion, through said unthreaded cavity portion and contacts said primary shaft.

6. The closure assembly of claim 2 wherein each of said first and second bracket means includes depth extension means for adjustably fixing the depth of the position within the frame at which said first and second bracket means contact said stiles, vertical extension means for adjustably fixing a vertical position of said roller rod, and lateral extension means for adjustably fixing a distance between said first and second bracket means.

7. The closure assembly of claim 6 wherein said bracket means includes:

a depth extender member comprising a vertical plate portion for contacting one of said stiles of said frame, a horizontal portion for contacting said horizontal connecting member of said frame, a first extender outer edge normal to said frame and positioned on said horizontal plate portion, a first extender flange extending from said first extender outer edge, a second extender outer edge normal to said frame and positioned on said vertical plate portion, a second extender flange extending from said second extender outer edge, a first extender guideway formed between said first extender flange and said first extender outer edge and a second extender guideway formed between said second extender flange and said second extender outer edge, a right angle shaped arm comprising:

a vertical planar portion normal to said frame, said vertical planar portion having a first arm vertical edge adjacent said frame and a second arm vertical edge, and a horizontal planar portion, said horizontal planar portion having a first arm horizontal edge, normal to said stiles and adjacent to said frame, and a second arm horizontal edge normal to said stiles; said arm being substantially longer than said depth extender member, and said arm being slidably received by said first extender guideway and said second extender guideway, depth extender securing means for holding said depth extender member in an adjusted position in relation to said arm, an upright interlocking member parallel to said frame, said upright interlocking member being connected to said first arm vertical edge and to said first arm horizontal edge, said upright interlocking member having a first upright interlocking vertical edge and a second upright interlocking vertical edge parallel to said stiles, and having a first upright interlocking guideway along said first upright interlocking vertical edge and a second upright interlocking guideway along said second upright interlocking vertical edge, an upright member parallel to said frame, said upright member being substantially longer than said upright interlocking member, said upright member having a top upright horizontal edge, a first upright vertical edge and a second uptight vertical edge, a first lateral upright flange extending from said first upright vertical edge and a second upright lateral flange extending from said second upright vertical edge, a first upright guideway formed between said first upright lateral flange and a second upright guideway formed between said second upright lateral flange, said first upright guideway and said second upright guideway being slidably interengaged with said first upright interlocking guideway and said second upright interlocking guideway, an upright interlocking member securing means for holding said upright interlocking member in an adjusted position in relation to said upright member, a lateral extension member positioned parallel to said frame including:

a lateral extension vertical edge in alignment with one of said upright vertical edges, top and bottom lateral extension longitudinal edges, a portion of said bottom lateral extension longitudinal edge being connected to said top upright horizontal edge, a lateral extension longitudinal flange positioned along each of said top and bottom lateral extension longitudinal edges, said lateral extension longitudinal flanges extending in a direction opposite to the direction in which said first upright lateral flange and said second upright lateral flange extends, and a lateral extension horizontal guideways formed by each of said lateral extension longitudinal flanges, a transverse member oriented parallel to said frame, said transverse member having a planar, rectangular first surface and a planar, rectangular second surface facing in opposite directions, said second surface facing the direction in which said arm extends from said upright interlocking member, said transverse member being slidably received in said lateral extension horizontal guideways, lateral extension member securing means for holding said lateral extension member in an adjusted position in relation to said transverse member, an intermediate member extending normally from said second surface of said transverse member, said intermediate member being positioned at an end of said second surface of said transverse member farthest from said upright member.

8. The closure assembly of claim 7 further including frame pads formed of a material having a high coefficient of friction, secured to said vertical planar portion of said depth extender member and to said horizontal planar portion of depth extender member.

9. The closure assembly of claim 7 further including:

a slat pocket positioned at the bottom of said closure between said first bracket means and said second bracket means, slat means having a length approximately equal to that of said closure and comprising a right angled association of three planar surfaces forming a slat cavity housing upward an opening and extending longitudinally across said slat means, said slat means being slidably received within said slat pocket, and a catch extending downward from the bottom of said upright member, said catch being thinner than said cavity of said slat means.

10. The closure assembly of claim 9 wherein said slat is a right angled formation of three planar surfaces and said catch is rectangular.

11. The closure assembly of claim 7 wherein said bracket means includes:

an elongated transverse member located outside of said frame and extending from said plate means in a direction normal to and away from said stile farthest from said plate means, and an intermediate member extending normally from said transverse member in a direction normal to said frame and away from said frame.

12. The closure assembly of claim 11 wherein a longitudinal axis of said roller rod is higher than the top of said frame.

13. The closure assembly of claim 2 wherein said expansive pressure means is located substantially within said housing, and said expensive pressure means includes:

a cylindrical housing cavity within said housing, the housing cavity having a closed cavity base, sides and an opening away from said first end of said roller rod, a forward shaft having an interior end within said housing cavity and having an exterior end protruding from said housing cavity and coupled to said second bracket means, forward shaft axial bearing means for maintaining said forward shaft within said housing cavity in axial alignment with said roller rod, and for permitting relative movement between said sides of said housing cavity and said forward shaft, a rearward shaft slidably associated with said interior end of said forward shaft and extending towards said base of said housing cavity, base bearing means for facilitating rotation between said rearward shaft and said base of said housing cavity, rearward shaft axial bearing means for maintaining said rearward shaft within said housing cavity in axial alignment with said roller rod, and for permitting relative movement between the sides of said housing cavity and said rearward shaft, spring means positioned between said forward shaft axial bearing means and said rearward shaft axial bearing means.

14. The closure assembly of claim 13 further including:

spring stop means bearing against said spring means, said spring stop means being positioned between said forward shaft axial bearing means and said rearward shaft bearing axial means, and locking means for fixing the position of said spring stop means relative to said housing when said closure assembly is mounted in said frame, said locking means being removable to permit translation of said spring stop means relative to said housing.

15. A closure assembly for mounting on a frame in a wall, said frame having a horizontal dimension and being formed of a pair of stiles connected by a horizontal connecting member, said closure assembly comprising in combination:

a rod having a first end and a second end, said rod being longer than the horizontal dimension of said frame, a closure coupled to said rod, said closure having a width which is greater than the horizontal dimension of said frame, first and second bracket means for positioning said rod minimally close to said wall, outside said frame, and at or above the top of said frame, said first bracket means being coupled to said first end of said rod, and an expansive pressure means for forcing said bracket means outwardly into static frictional engagement with said stiles of said frame, said expansive pressure means being located substantially within said rod and said expansive pressure means being coupled to said second bracket means, said first and second bracket means including plate means for contacting said stiles of said frame, whereby said closure assembly may be quickly mounted for covering said frame completely and closely to minimize the passage of insects, light or visibility through said frame.

16. The closure assembly of claim 15 wherein each of said first and second bracket means include depth extension means for adjustably fixing the depth of the position within the frame at which said first and second bracket means contact said stiles, vertical extension means for adjustably fixing a vertical position of said roller rod, and lateral extension means for adjustably fixing a distance between said first and second bracket means.

17. The closure assembly of claim 15 wherein said bracket means includes:

a depth extender member comprising a vertical plate portion for contacting one of said stiles of said frame, a horizontal portion for contacting said horizontal connecting member of said frame, a first extender outer edge normal to said frame and positioned on said horizontal plate portion, a first extender flange extending from said first extender outer edge, a second extender outer edge normal to said frame and positioned on said vertical plate portion, a second extender flange extending from said second extender outer edge, a first extender guideway formed between said first extender flange and said first extender outer edge and a second extender guideway formed between said second extender flange and said second extender outer edge, a right angle shaped arm comprising:

a vertical planar portion normal to said frame, said vertical planar portion having a first arm vertical edge adjacent said frame and a second arm vertical edge, and a horizontal planar portion, said horizontal planar portion having a first arm horizontal edge, normal to said stiles and adjacent to said frame, and a second arm horizontal edge normal to said stiles;

said arm being substantially longer than said depth extender member, and said arm being slidably received by said first extender guideway and said second extender guideway, depth extender securing means for holding said depth extender member in an adjusted position in relation to said arm, an upright interlocking member parallel to said frame, said upright interlocking member being connected to said first arm vertical edge and to said first arm horizontal edge, said upright interlocking member having a first upright interlocking vertical edge and a second upright interlocking vertical edge parallel to said stiles, and having a first upright interlocking guideway along said first upright interlocking vertical edge guideway and a second upright interlocking guideway along said second upright interlocking vertical edge, an upright member parallel to said frame, said upright member being substantially longer than said upright interlocking member, said upright member having a top upright horizontal edge, a first upright vertical edge and a second upright vertical edge, a first lateral upright flange extending from said first upright vertical edge and a second upright lateral flange extending from said second upright vertical edge, a first upright guideway formed between said first upright lateral flange and a second upright guideway formed between said second upright lateral flange, said first upright guideway and said second upright guideway being slidably interengaged with said first upright interlocking guideway and said second upright interlocking guideway, an upright interlocking member securing means for holding said upright interlocking member in an adjusted position in relation to said upright member, a lateral extension member positioned parallel to said frame including:

a lateral extension vertical edge in alignment with one of said upright vertical edges, top and bottom lateral extension longitudinal edges, a portion of said bottom lateral extension longitudinal edge being connected to said top upright horizontal edge, a lateral extension longitudinal flange positioned along each of said top and bottom lateral extension longitudinal edges, said lateral extension longitudinal flanges extending in a direction opposite to the direction in which said first upright lateral flange and said second upright lateral flange extends, and lateral extension horizontal guideways formed by each of said lateral extension longitudinal flanges, a transverse member oriented parallel to said frame, said transverse member having a planar, rectangular first surface and a planar, rectangular second surface facing in opposite directions, said second surface facing the direction in which said arm extends from said upright interlocking member, said transverse member being slidably received in said lateral extension horizontal guideways, lateral extension member securing means for holding said lateral extension member in an adjusted position in relation to said transverse member, an intermediate member extending normally from said second surface of said transverse member, said intermediate member being positioned at an end of said second surface of said transverse member farthest from said upright member, the length of said elongated portion of said intermediate member being less than or approximately equal to the width of said rod.

18. The closure assembly of claim 16 further including frame pads formed of a material having a high coefficient of friction, secured to said vertical planar portion of said depth extender member and to said horizontal planar portion of depth extender member.

19. The closure assembly of claim 15 further including telescopic means for adjusting the length of said rod and length maintenance means for maintaining the length of said rod when said closure assembly is mounted.

20. The closure assembly of claim 15 wherein said expensive pressure means includes:

an axial cavity within said second end of said rod, the axial cavity having a closed cavity base, sides and an opening away from said first end of said roller rod, a shaft having an interior end within said housing cavity and having an exterior end protruding from said axial cavity and coupled to said second bracket means, shaft bearing means for maintaining said shaft within said cavity in axial alignment with said roller rod, and for permitting relative movement between said sides of said axial cavity and said axial shaft, and spring means positioned between said shaft bearing means and said closed cavity base.

21. The closure assembly of claim 20 further including:

spring stop means bearing against said spring means, said spring stop means being positioned between said shaft bearing means and said closed cavity base, and locking means for fixing the position of said spring stop means relative to an axis of said cavity when said closure assembly is mounted, said locking means being removable to permit translation of said spring stop means relative to said cavity.

22. The closure assembly of claim 15 wherein said bracket means includes:

an elongated transverse member located outside of said frame and extending from said plate means in a direction normal to and away from said stile farthest from said plate means, and an intermediate member extending normally from said transverse member in a direction normal to said frame and away from said frame.

23. The closure assembly of claim 22 wherein a longitudinal axis of said rod is higher than the top of said frame.

* * * * *